US010414642B2

(12) United States Patent
Melville, Jr. et al.

(10) Patent No.: US 10,414,642 B2
(45) Date of Patent: Sep. 17, 2019

(54) COLD BEVERAGE DISPENSER AND FLEXIBLE POUCH

(71) Applicant: BIBO BARMAID LLC, Clinton, NJ (US)

(72) Inventors: Douglas F. Melville, Jr., Simsbury, CT (US); Gary M. Barch, Simsbury, CT (US); Craig Bures, Prospect, CT (US); Debra L. Walker, Clinton, NJ (US)

(73) Assignee: Bibo Barmaid LLC, Clinton, NJ (US)

( * ) Notice: Subject to any disclaimer, the term of this patent is extended or adjusted under 35 U.S.C. 154(b) by 168 days.

(21) Appl. No.: 15/193,054

(22) Filed: Jun. 25, 2016

(65) Prior Publication Data

US 2016/0376139 A1 Dec. 29, 2016

Related U.S. Application Data

(63) Continuation-in-part of application No. 15/060,706, filed on Mar. 4, 2016, now Pat. No. 9,932,218, and a (Continued)

(51) Int. Cl.
*B65D 85/72* (2006.01)
*B67D 1/08* (2006.01)

(Continued)

(52) U.S. Cl.
CPC ..... *B67D 1/0021* (2013.01); *B65D 75/5866* (2013.01); *B65D 85/804* (2013.01);

(Continued)

(58) Field of Classification Search
CPC ..... B67D 1/0021; B67D 1/06; B67D 1/0001; B67D 1/0046; B67D 1/0894;

(Continued)

(56) References Cited

U.S. PATENT DOCUMENTS 2,103,389 A * 12/1937 Salfisberg ..... B65D 75/5811 156/183
2,635,788 A 4/1953 Snyder et al.

(Continued)

FOREIGN PATENT DOCUMENTS

EP 0299767 A1 1/1989
JP H09290898 A 11/1991

(Continued)

OTHER PUBLICATIONS

"Post Mix Soda Fountains", The CHI Company, New and Used Beverage Equipment for Honest Prices, Retrieved Date: Oct. 14, 2014, Retrieved at: <http://www.chicompany.net/index.php?main_page=index&cPath=25>, 3 pages.

(Continued)

*Primary Examiner* — Nicolas A Arnett
(74) *Attorney, Agent, or Firm* — Medley, Behrens & Lewis LLC; Lorri W. Cooper

(57) ABSTRACT

A beverage dispenser includes a housing, a first pouch, a cutting mechanism, a water source, and a pump. The housing has at least a first receptacle. The first pouch has a beverage content for seating in the first receptacle and has an opening area thereon for opening the pouch. The cutting mechanism for opening the first pouch in the opening area of the pouch in order to allow the contents thereof to evacuate from the pouch. The water source is coupled to the housing permitting water to mix with the contents of the pouch. The pump coupled to the water reservoir for transferring water from the water reservoir to the vicinity of the first receptacle such that water from the water reservoir mixes with the contents of the pouch. The opening area of the pouch permits cutting or slicing of the pouch with the cutting mechanism.

16 Claims, 13 Drawing Sheets

Related U.S. Application Data continuation-in-part of application No. 15/060,716, filed on Mar. 4, 2016, and a continuation-in-part of application No. 14/806,522, filed on Jul. 22, 2015, now Pat. No. 9,695,030.

(60) Provisional application No. 62/027,286, filed on Jul. 22, 2014.

(51) Int. Cl.
*B67D 1/00* (2006.01)
*B67D 1/06* (2006.01)
*B65D 75/58* (2006.01)
*B65D 85/804* (2006.01)

(52) U.S. Cl.
CPC ..... *B67D 1/0001* (2013.01); *B67D 1/0046* (2013.01); *B67D 1/0078* (2013.01); *B67D 1/06* (2013.01); *B67D 1/0894* (2013.01); *B67D 2001/0091* (2013.01)

(58) Field of Classification Search
CPC ..... B67D 1/0078; B67D 2001/0091; B65D 85/804; B65D 75/5866
See application file for complete search history.

(56) References Cited

U.S. PATENT DOCUMENTS 2,663,461 A * 12/1953 Brown ..... A61J 1/067 206/820
3,009,498 A * 11/1961 Fohr ..... B65D 31/145 116/DIG. 9
3,186,625 A * 6/1965 McAd ..... B65D 85/80 383/200
3,199,437 A * 8/1965 Nelsen ..... A47J 31/02 206/219
3,429,495 A * 2/1969 McClosky ..... B65D 75/20 206/820
4,171,755 A * 10/1979 Carlisle ..... B65D 75/48 206/390
4,463,876 A * 8/1984 Swallert ..... A47K 5/1215 222/105
4,759,472 A * 7/1988 Strenger ..... B65D 75/5822 222/541.4
4,808,346 A * 2/1989 Strenger ..... A47J 31/407 222/129.1
D304,299 S 10/1989 Sakamoto
D306,555 S 3/1990 Lane et al.
4,915,261 A * 4/1990 Strenger ..... A47J 31/407 222/107
D309,432 S 7/1990 Mancini
4,981,374 A * 1/1991 Rutter ..... B65B 9/13 206/459.5
D319,976 S 9/1991 Wortley et al.
5,067,635 A * 11/1991 Thomsen ..... B65D 35/28 222/103
D351,992 S * 11/1994 Jacques ..... D9/696
D354,906 S 1/1995 Lane, Jr. et al.
5,497,913 A * 3/1996 Baker ..... A61C 9/0026 222/102
D392,559 S 3/1998 Smith et al.
6,076,968 A * 6/2000 Smith ..... B65D 75/008 383/104
6,079,315 A 6/2000 Beaulieu et al.
6,116,782 A * 9/2000 Arkins ..... B32B 27/08 383/202
6,155,457 A * 12/2000 Landa ..... G03G 15/104 222/327
6,164,825 A 12/2000 Larkin et al.
D442,078 S 5/2001 Fuquen
D452,144 S 12/2001 Tedeschi, Jr. et al.
D455,645 S 4/2002 Bell et al.
D463,974 S 10/2002 Berman
6,606,938 B2 8/2003 Taylor
6,607,762 B2 8/2003 Lazaris et al.
6,655,260 B2 12/2003 Lazaris et al.
D484,972 S 1/2004 Steele, IV et al.
D501,399 S 2/2005 Tobolka
6,935,781 B2 * 8/2005 Makino ..... A47G 23/0258 383/16
D509,751 S 9/2005 Risgalla
D523,758 S 6/2006 Risgalla
7,055,683 B2 * 6/2006 Bourque ..... B29C 65/76 206/219
D533,462 S 12/2006 Bachmann
7,165,488 B2 1/2007 Bragg et al.
D545,689 S 7/2007 Peel
D550,568 S 9/2007 Lau et al.
D555,010 S 11/2007 Maier et al.
7,306,095 B1 * 12/2007 Bourque ..... B29C 65/76 206/219
D558,594 S 1/2008 Kirou et al.
7,347,138 B2 3/2008 Bragg et al.
7,360,418 B2 4/2008 Pelovitz
7,377,162 B2 5/2008 Lazaris
7,398,726 B2 7/2008 Streeter et al.
D578,010 S 10/2008 Friedland et al.
D578,011 S 10/2008 Friedland et al.
D578,016 S 10/2008 Friedland et al.
D578,017 S 10/2008 Friedland et al.
D578,018 S 10/2008 Friedland et al.
D578,019 S 10/2008 Friedland et al.
D580,780 S 11/2008 Kelly et al.
D580,782 S 11/2008 Murray
D585,302 S 1/2009 Beyer et al.
D586,231 S 2/2009 Friedland et al.
D587,597 S 3/2009 Friedland et al.
7,513,192 B2 4/2009 Sullivan et al.
D595,592 S 7/2009 Beyer et al.
D601,037 S 9/2009 Beyer et al.
7,640,845 B2 1/2010 Woodnorth et al.
D610,467 S 2/2010 Kozarsky
D613,181 S 4/2010 Friedland et al.
D623,536 S 9/2010 Bohmke
D627,236 S 11/2010 Kozarsky
7,950,850 B2 * 5/2011 Fukuizumi ..... B65D 75/42 383/120
D640,566 S 6/2011 Norlin et al.
D643,745 S 8/2011 Hartley
8,091,735 B2 1/2012 Girard et al.
8,104,642 B2 1/2012 Bambrick et al.
8,151,694 B2 4/2012 Jacobs et al.
D668,554 S 10/2012 Tsuchiya
8,361,527 B2 1/2013 Winkler et al.
D676,335 S 2/2013 Murray
D676,336 S 2/2013 Murray
8,481,097 B2 * 7/2013 Skalski ..... A47J 31/0668 426/115
8,495,949 B2 7/2013 Tinkler et al.
8,516,948 B2 7/2013 Zimmerman et al.
D689,371 S 9/2013 Ross
D689,776 S 9/2013 Murray
D692,315 S 10/2013 Bohmke et al.
D692,316 S 10/2013 Bohmke et al.
D693,241 S 11/2013 Kilber et al.
8,573,114 B2 11/2013 Huang et al.
8,590,753 B2 11/2013 Marina et al.
D695,132 S 12/2013 Bouthillon
8,609,170 B2 12/2013 Tinkler et al.
D698,663 S 2/2014 Lin
D700,066 S 2/2014 Berman
8,667,892 B2 3/2014 Cominelli et al.
8,673,379 B2 * 3/2014 Skalski ..... A47J 31/0668 426/115
D703,549 S 4/2014 Murray
8,708,195 B1 4/2014 Duran
8,740,020 B2 6/2014 Marina et al.
8,757,222 B2 6/2014 Rudick et al.
8,808,775 B2 8/2014 Novak et al.
8,881,948 B1 11/2014 Lassota
D723,385 S 3/2015 Gaudard

(56) References Cited

U.S. PATENT DOCUMENTS

| | | | | |
|---|---|---|---|---|
| 8,985,395 | B2 * | 3/2015 | Tansey | A47J 31/44 222/101 |
| 9,061,819 | B2 * | 6/2015 | Kane, Jr. | B65D 25/08 |
| D736,099 | S | 8/2015 | Deuerer | |
| 9,365,405 | B2 * | 6/2016 | Stratton | B67D 1/0021 |
| 9,701,527 | B2 * | 7/2017 | Tansey, Jr. | A47J 31/44 |
| 9,783,403 | B2 * | 10/2017 | Tansey, Jr. | A47J 31/44 |
| 9,809,437 | B2 * | 11/2017 | Tansey, Jr. | B67D 1/0021 |
| 2004/0007588 | A1 * | 1/2004 | Danby | A21B 7/00 222/94 |
| 2004/0118710 | A1 * | 6/2004 | Bourque | B29C 65/76 206/219 |
| 2005/0109796 | A1 * | 5/2005 | Bourque | B65D 75/008 222/94 |
| 2006/0118581 | A1 | 6/2006 | Clark | |
| 2008/0010950 | A1 * | 1/2008 | Peck | B65D 75/42 53/452 |
| 2008/0314927 | A1 | 12/2008 | Martin | |
| 2009/0057340 | A1 | 3/2009 | Moothart | |
| 2009/0120961 | A1 | 5/2009 | Dietschi et al. | |
| 2010/0116842 | A1 | 5/2010 | Hecht et al. | |
| 2010/0154919 | A1 | 6/2010 | Jansen | |
| 2010/0269707 | A1 | 10/2010 | Wiemer et al. | |
| 2011/0166910 | A1 | 7/2011 | Marina et al. | |
| 2011/0226343 | A1 | 9/2011 | Novak et al. | |
| 2012/0183657 | A1 | 6/2012 | Marina et al. | |
| 2013/0015206 | A1 | 1/2013 | van Haperen et al. | |
| 2013/0042941 | A1 | 2/2013 | van Haperen et al. | |
| 2013/0062366 | A1 * | 3/2013 | Tansey | A47J 31/44 222/102 |
| 2013/0077898 | A1 * | 3/2013 | Doll | B32B 38/04 383/202 |
| 2013/0233180 | A1 | 9/2013 | Belmont | |
| 2014/0069953 | A1 | 3/2014 | Metropulos et al. | |
| 2014/0072678 | A1 | 3/2014 | Jenkins | |
| 2014/0106048 | A1 | 4/2014 | Harper | |
| 2014/0114469 | A1 | 4/2014 | Givens et al. | |
| 2014/0134299 | A1 | 5/2014 | Guidorzi et al. | |
| 2014/0175125 | A1 | 6/2014 | Breault | |
| 2014/0209634 | A1 | 7/2014 | Metropulos et al. | |
| 2014/0224130 | A1 | 8/2014 | Castellani et al. | |
| 2014/0263407 | A1 | 9/2014 | Rudick et al. | |
| 2014/0263414 | A1 | 9/2014 | San Miguel et al. | |
| 2014/0372233 | A1 | 12/2014 | Knecht et al. | |
| 2015/0125586 | A1 | 5/2015 | Ergican | |
| 2015/0151956 | A1 * | 6/2015 | Tansey | A47J 31/44 222/82 |
| 2015/0175400 | A1 * | 6/2015 | Newman | B67D 1/0021 222/1 |
| 2015/0183627 | A1 * | 7/2015 | Tansey, Jr. | A47J 31/44 426/416 |
| 2015/0217986 | A1 * | 8/2015 | Tansey, Jr. | A47J 31/44 222/1 |
| 2015/0307248 | A1 | 10/2015 | Patwardhan et al. | |
| 2016/0023879 | A1 | 1/2016 | Walker et al. | |
| 2016/0251208 | A1 * | 9/2016 | Tansey, Jr. | A47J 31/44 222/95 |
| 2016/0376140 | A1 * | 12/2016 | Tansey, Jr. | A47J 31/44 700/236 |
| 2017/0253402 | A1 * | 9/2017 | Melville, Jr. | B65D 75/322 |

FOREIGN PATENT DOCUMENTS

| | | | |
|---|---|---|---|
| RU | 69850 | U1 | 1/2008 |
| WO | 2004075702 | A1 | 9/2004 |
| WO | 2008104751 | A1 | 9/2008 |

OTHER PUBLICATIONS

"International Search Report and Written Opinion for PCT/US2015/041632", dated Oct. 29, 2015, 7 pages.

"International Search Report and Written Opinion for PCT Patent Application No. PCT/US2017/020841", dated Jun. 29, 2017, 7 pages.

Google Image Search Results for Single Serve Liquid Portion Pack Pouch, Retrieved Date: Sep. 15, 2015, Retrieved At: <<https://www.google.com/search?q=single+serve+liquid+portion+pac+pouch&rlz=1T4GGHP_enUS617US617&source=lnms&tbm=isch>>, pp. 1-7.

Google Image Search Results for Pouch Shapes, Retrieved Date: Sep. 15, 2015, Retrieved At: <<https://www.google.com/search?q=pouch+shapes&rlz=1T4GGHP_enUS617US617&tbm=isch&tbo=u&source=univ&sa=X&ved=0CB4Q>>, pp. 1-8.

* cited by examiner

COLD BEVERAGE DISPENSER AND FLEXIBLE POUCH

CROSS-REFERENCE TO RELATED APPLICATIONS

This application is a continuation-in-part to U.S. patent application Ser. No. 14/806,522, filed on Jul. 22, 2015, which claims priority to Provisional application No. 62/027,286, filed on Jul. 22, 2014; to U.S. patent application Ser. No. 15/060,716, filed on Mar. 4, 2016; and to U.S. patent application Ser. No. 15/060,706, filed on Mar. 4, 2016, the disclosures of which are incorporated herein by reference in their entireties.

FIELD

The examples described herein relate to a pouch and to a cold beverage dispenser and pouch for use in making mixed drinks and/or health and wellness drinks.

BACKGROUND

Many consumers enjoy trying different alcoholic beverages. Often, in order to try multiple types of beverages, it is necessary to purchase a multitude of ingredients and multiple bottles of alcohol. This can be very costly and requires a significant amount of storage, since bottle are often not emptied and need to be stored. Because of this, consumers tend to stick with a certain type of drink. Countertop single serve coffee makers have become very popular among consumers. These countertop coffee makers include a brewer which heats water from a reservoir and inputs hot water to a single serve container that houses coffee grinds and a filter. Coffee is "brewed" in the container and then permitted to exit the brewer into a cup.

SUMMARY

A cold beverage dispenser and a flexible pouch are shown and described.

BRIEF DESCRIPTION OF THE DRAWINGS

FIG. 5 is a cross-sectional view of the beverage dispenser shown in FIG. 1 with the pouch slots in an empty state and the cover in a closed state;

FIG. 6 is a cross-sectional view similar to that shown in FIG. 5, but with pouches positioned ion the pouch slots with the cover open;

FIG. 7 is a cross-sectional view similar to that shown in FIG. 6, but with the cover in a state where it is beginning to be closed;

FIG. 8 is a cross-section view of the beverage dispenser similar to that in FIG. 7, but with the cover closed and the cutting blade fully engaged with the pouches;

FIG. 9 is a cross-sectional view of the beverage dispenser after the cutting mechanism has engaged the pouches and has been retracted partially;

FIG. 10 is a cross-sectional view of the beverage dispenser after the cutting mechanism has been fully retracted, but with the cover still in a closed state;

DETAILED DESCRIPTION

Figure 1:
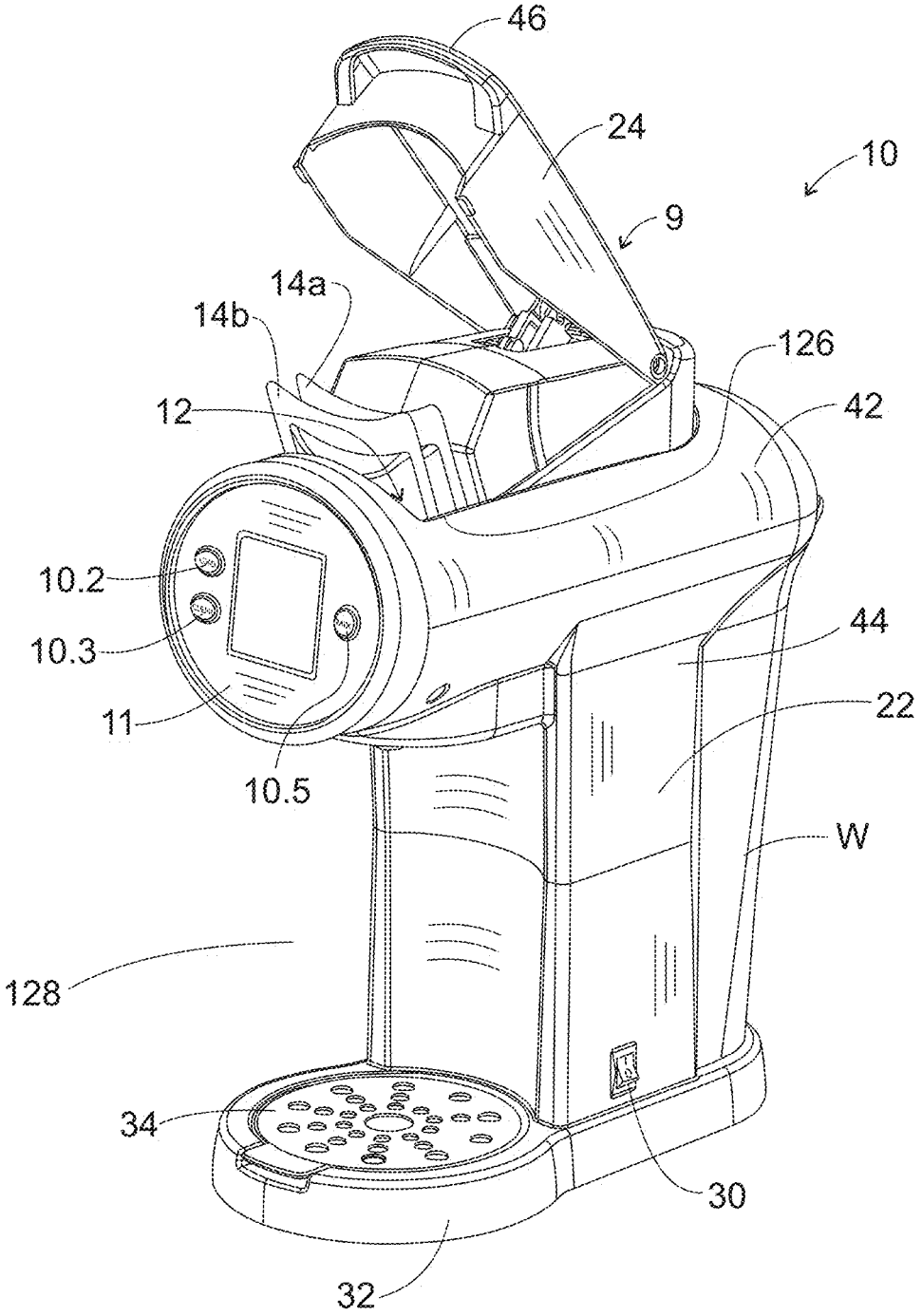
FIG. 1 shows an example beverage maker according to the invention.

Consumers enjoy trying mixed drinks. Drink specialty menus are very popular at most restaurants. However, specialty drinks are often expensive to purchase. Consumers often would like to try specialty drinks at home, but it can be costly to purchase all the ingredients. In addition, consumers need to find recipes on their own. The cold beverage dispenser 10 described herein provides a solution for consumers to be able to make many different kind of drinks, including specialty drinks, without having to find a recipe, purchase ingredients, and mix various ingredients together.

In one example, the device 10 is an on-the-counter machine targeted to the casual cocktail market for people who want to try a variety of drinks, but don't necessarily want to invest in large amounts of expensive ingredients. In this example, the machine 10 is single-serve and permits a consumer to mix a wide variety of ingredients together to make a cocktail. The machine 10 has 2 receptacles or slots 12 for receiving ingredient containers or pouches 14, as well as a reservoir W for holding water. In another embodiment, the machine 10 may have one or more slots, such as 4 slots or 3 slots.

The receptacles 12 are configured to accept containers 14, such as single-serve containers, that include liquid ingredients or a slurry of ingredients. Alternatively, the containers 14 could hold powder ingredients. As another alternative, the containers could have multiple receptacles for receiving multiple ingredients in a single pouch, as will be discussed in greater detail below.

By utilizing multiple containers 14 in multiple receptacles 12, the consumer has the ability to create hundreds of cocktails. The containers 14 may include cocktail mixers (such as juice and other ingredients) or alcohol products (such as vodka, gin, whiskey, and the like). A typical cocktail can be made using one alcohol container 14 and one mixer container 14, for example. Alternatively, a single container could include both alcohol and a mixer that are disposed in separate compartments in the same pouch, or that are mixed together in a single compartment within a pouch. This type of pouch may be useful with cocktails that require more than one type of alcohol, such as a long island iced tea. The containers 14 are input separately into the receptacles 12 in the dispensing machine 10 and the alcohol is typically not mixed with the mixers prior to activation of the dispensing machine 10, although there may be some formulations where alcohol is mixed with a mixer in the container 14.

The size of the containers 14 may vary relative to the alcohol pouches and relative to what is required in order to make a drink recipe. Alternatively, the alcohol pouches and the mixer pouches may be substantially the same size so that they can utilize the same manufacturing line for production of the pouches.

The pouches include an opening area that is an area of the pouch that receives a cutting or opening mechanism. As discussed in greater detail below, the cutting mechanism may be a blade that slices through the front or back surface of the pouch. When the pouches have more than one compartment, the compartments should be positioned so that the blade may open both compartments. In addition, the pouches may be formed such that each compartment has a slanted surface in order to promote the exiting of the contents of the compartment via gravity.

The contents of the containers 14 are formulated so that they allow the consumer to make the "perfect" drink every time because the mixers are proportioned to exactly match the amount of alcohol in the alcohol container 14. This allows the consumer great ease to try a variety of drinks, mixed perfectly, in their own home. No measuring of ingredients is needed. The consumer only has to insert the containers 14 into the receptacles 12 and let the machine 10 prepare the cocktail. This is also advantageous because the consumer is not required to purchase a multitude of costly ingredients, which inevitably do not get entirely used, leaving half empty bottle to rest in the cupboard or refrigerator and take up space.

The Alcohol and Tobacco Tax and Trade Bureau (TTB) regulates the labeling, advertising and marketing of alcoholic beverages in the United States. Wine and liquor may only be sold in standard sizes. The smallest size bottle of distilled spirits permitted to be sold in the United States is referred to as a miniature and has a size of 50 ml or 1.7 ounces. A typical shot that is dispensed in US bars is between 1 ounce and 1.5 ounces. The "shot" dispensed in connection with the subject dispenser 10 is 1.7 ounces in order to conform to US sizing standards. This may change over time if federal regulations change. Other sizes may be used in other jurisdictions, such as foreign jurisdictions, with the size of the "shot" not being limited to 50 ml. The mixers utilized with the dispensing device 10 are formulated for use with 1.7 ounces of liquor. If a different size alcohol "shot" is permitted to be sold, then the mixers can be adjusted based upon the quantity of alcohol in the "shot" pouch. Double shots of alcohol may be used by either using a larger container 14 in the receptacle 12 or by using two alcohol containers 14, each having 1.7 ounces of alcohol. In one example, the dispenser 10 may have the capacity to make a "double" so that 3 ounces of alcohol are used at minimum, along with about 8 oz. of mixer. Alcohol may be dispensed as a precisely measured mixologist bartender shot, if desired and permitted under local laws.

The example drink dispenser 10 takes a pouch 14 of ingredients, adds water and dispenses it into a cup 16. When alcohol pouches 14 are also desired and available, the consumer may place both the mixer pouch and the alcohol pouch in the drink dispenser 10 in order to create a cocktail. When alcohol pouches 14 are not available, the consumer can take a mixer pouch 14 and place it into the drink dispenser 10 in order to make the cocktail and can add a shot of their favorite spirit using a premeasured shot glass that can be included with the system.

The device 10 may include a funnel 18, a mixing chamber 120, or, alternatively, the ingredients may simply flow directly into an underlying cup 16. A funnel 18 may be used in order to direct the ingredients into the underlying cup 16 while a mixing reservoir 120 will typically have a valve 122 positioned at its outlet in order to allow mixing of ingredients in the mixing reservoir 120 before the valve 122 is opened. Both the funnel 18 and the mixing chamber 120 have an outlet 124 through which the combined ingredients may exit the mixing chamber 120 or funnel. When a mixing chamber 120 is utilized, swirling motion created by the input of water may permit the ingredients to mix before exiting the dispenser 10.

In yet another embodiment, a motorized blender (not shown) may be utilized to receive the ingredients and water in place of the mixing reservoir 120 so that the ingredients can be blended together before being dispensed into a cup 16. The blender may have an outlet 124 that is closed and opened by a valve 122 in order to permit blending in the blender before dispensing.

The dispensing device 10 may alternatively be used to make health drinks, such as those that include nutritional supplements or other "health food" related components. One type of ingredient may be a mixture of vitamins in a concentrated liquid form, which are known to be more readily absorbed by the body. Alternatively, a powder-based mix may be used, with water from a water supply W, with the water being used to make the powder-based mix flow out of the dispenser 10. Other types of health enhancing products may be used including vitamins, minerals, and other nutrients or products, as known by those of skill in the art. Pureed fruits and vegetables may be utilized to incorporate fruits and vegetables, if desired. For example, a kale-based pouch 14 could be used along with a mango-based pouch 14 along with a supplement pouch 14. Alternatively, these ingredients could be combined into a single pouch such that the compartments that house the ingredients are aligned with the opening area so that the ingredients may all flow from the pouch 14. Juices may be used. This permits the user to customize their "health" drink to find a drink mixture that they enjoy.

The device 10 may have a refrigeration component or chiller (not shown) and may include an ice dispenser (not shown). Alternatively, ice may be added to the cup or glass 16 before or after the liquid mixture is dispensed into the cup/glass 16. The liquid mixture may also be dispensed into other types of receptacles, such as pitchers or mugs, for example (not shown). A chiller could be used to chill the water or the ingredients in the containers 14. It is envisioned that larger pouches could be utilized to make half and whole pitchers of cocktails, if desired. When larger pouches are utilized, the receptacles in the dispensing device 10 must be large enough to accept the larger pouches.

An exterior view of an example dispensing device 10 is shown in FIG. 1. The device 10 is an on-the-counter machine targeted to the casual cocktail market for people who want to try a variety of drinks, but don't necessarily want to invest in large amounts of expensive ingredients. In this example, the machine 10 is single-serve. The example dispensing device 10 has a reservoir for holding water W. Two receptacles 12 are shown positioned on an upper surface 126 of the dispensing device 10. (More receptacles could be provided if desired). An opening 128 is shown in the side or end of the device 10 for accepting a cup 16 and a drip tray 34. Liquid is dispensed from the interior of the device 10 into the cup 16.

Containers 14*a*, 14*b* may enter the receptacles 12 via an opening in the top 126, as one example. The receptacles 12 are configured to accept single serve containers 14 that include liquid ingredients. The containers are shown as being in pouch form and have a thin wall that is conducive to slicing. Alternatively, the containers 14 could hold powder ingredients, as discussed above.

The dispenser 10 of FIG. 1 includes a housing 22, a water reservoir W, a cover 24, multiple receptacles 12 for receiving containers 14, a cutter assembly 9, a display panel 11, an on/off switch 26, and a catch tray 30. The catch tray 30 may include a liner 32. The display panel 11 includes an LED screen 10.8 that may be back lit. The display panel 11 shown includes a "mix" button 10.5, a "clean" button 10.3, and a "read" button 10.2. The "read" button may alternatively be an "INFO" or "HELP" button. Other buttons may also be provided. As shown, the containers 14 are inserted substantially vertically. In one embodiment, the containers 14 are inserted at an approximately 20 degree angle so that they lean forward against part of the housing 22 once installed. This 20 degree angle is considered to be "substantially vertically," as would an angle of about 0, 5, 10, 15, 20, 25, 30, 35, 40, 45, or 50 degrees.

The display 11 and housing 22 are coupled together and form a unit. The cutter assembly 9 is a cassette that can be removed for cleaning. The housing 22 contains ridges or other surfaces (not shown) for receiving the cutting assembly 9 so that the cutting assembly seats in a top opening of the unit. A clip 28 may be positioned on the sides of the cutting assembly 9 for coupling with a groove (not shown) inside the housing 22 in order to hold the cutting assembly 9 in position in the housing 22. Other means may also be provided for coupling the cutter assembly 9 to the housing 22.

A divider 36 is provided between the first and second receptacles 12. The divider 36 may be removable from the housing 22 and is used to separate the two containers 14 in order to provide two separate receptacles 12 for receiving both containers 14 in the housing 22. The divider 36 has a slot 38 through which a cutting blade 40 can move horizontally. The divider 36 may be positioned in the housing 22 to abut grooves or slots (not shown) in the housing 22 interior. The divider 36 may be coupled in any known manner to the housing 22.

A water reservoir W is positioned on a rear end of the housing 22 and is removable from the housing 22 for filling purposes. The water reservoir may include seals and sensors, as known by those of skill in the art, in order to avoid leakage and in order to sense when the reservoir is running low on water. A pump 17.1 is coupled to the water reservoir W and is used to pump water through water lines in the housing 22 in order to mix the water with ingredients stored in the containers 14, as shown better in FIGS. 5-10.

The display panel 11 includes switches associated with the read 10.2, mix 10.5 and clean 10.3 buttons. Housing 22 includes an upper housing portion 42 and a lower housing portion 44. The upper housing portion 42 is broken into two parts, and a large opening is provided in the upper housing 42 in order to accept the cutter assembly 9 therein.

FIGS. 2A-2E represent different possible variations for dispensing from the containers 14 and the introduction of water into the system 10. The examples presented are non-exhaustive. Other variations are also possible and would be recognized by those of skill in the art. The dispensing device 10 has a water reservoir W or other water source. A fluid line 138 is coupled to the water reservoir W and a pump P. The fluid line 138 communicates with the containers 14 in order to mix water with the ingredients of the containers 14. Two containers 14 are shown, but more than two containers 14 may be used if desired.

FIGS. 2A-2C and 2E represent a direct deposit method of depositing the liquid into a cup 16, which is similar to the method used for the device shown in FIG. 1. In these embodiments, liquid enters a funnel shaped member 18 and is deposited directly into the cup 16 that is positioned under an opening 124 in the bottom of the funnel 18. While a funnel shape is shown, other shapes may be used as long as they permit all the liquid to travel out of the dispensing device 10 and provide a function of a funnel. A controller C is shown coupled to the pump P in order to regulate the flow of water from the pump P to the funnel 18 or to the containers 14. A controller C could also be used for opening and closing valves 122, or for moving an opening mechanism 40, such as a piercer or cutter into position, among other functions.

Figure 2C:
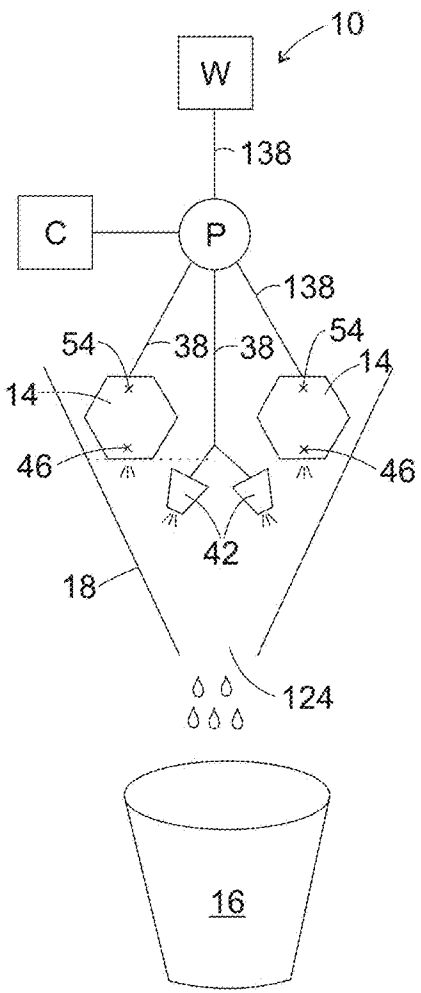
FIG. 2*c* depicts a schematic of a third example dispenser according to the invention.
Figure 2B:
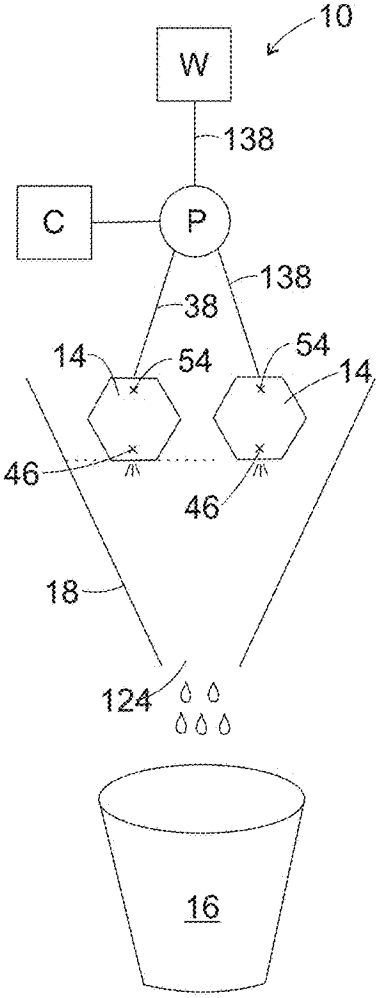
FIG. 2*b* depicts a schematic of a second example dispenser according to the invention.
Figure 2A:
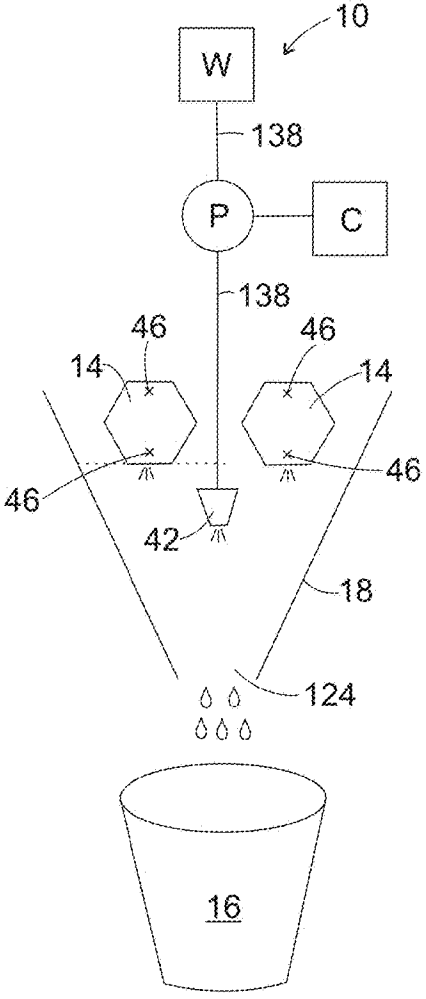
FIG. 2*a* depicts a schematic of a first example dispenser according to the invention.

FIG. 2A depicts a system 10 where the liquid in the containers 14 flows from the containers 14 into the funnel 18 while liquid from the water source W is pumped via the pump P into the funnel 18. The water can be directed in any manner desired, such as in a swirling pattern to assist in cleaning the funnel 18. Water may be sprayed through a nozzle 42, if desired, or may simply be deposited from a water line 138. Liquid can exit the containers 14 by gravity or squeezing.

FIG. 2B is similar to FIG. 2A except the water from the pump P is directed into the containers 14 in order to wash the interior of the containers 14 so that all liquid exits the containers 14 and flows into the funnel 18. This method would involve a means for opening a top end of the containers 14 in order to allow water to enter into a top end of the containers.

FIG. 2C is similar to FIGS. 2A and 2B. Water flows from the water source W though both containers 14 and through nozzles 42 that are positioned in the funnel 18 in order to wash the ingredients of the container 14 from the funnel 18 as the combined mixture enters the cup 16.

Figure 2E:
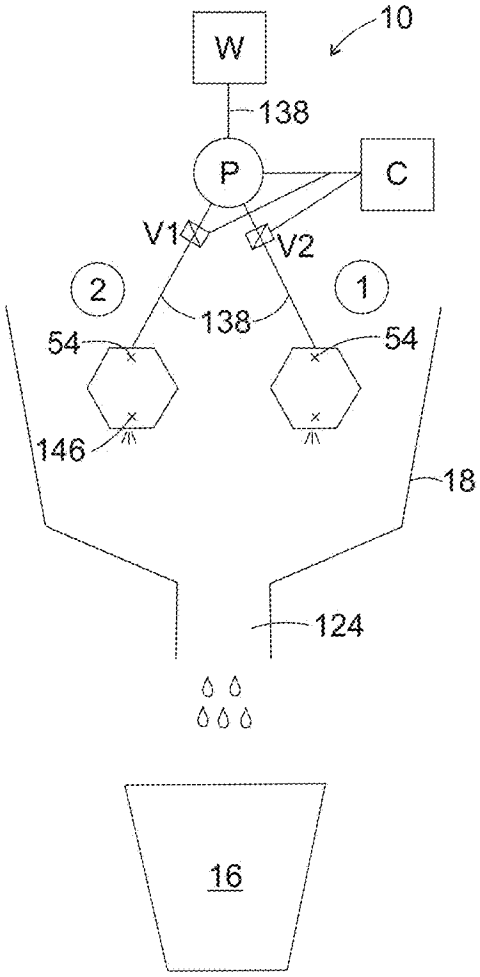
FIG. 2*e* depicts a schematic of a fifth example dispenser according to the invention.
Figure 2D:
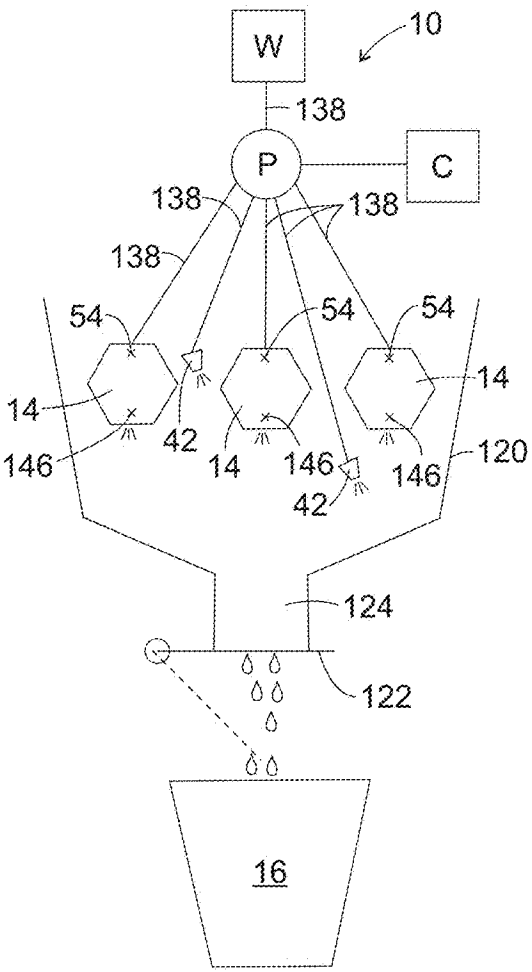
FIG. 2*d* depicts a schematic of a fourth example dispenser according to the invention.

FIG. 2D depicts an alternative embodiment that has three containers 14. The containers 14 communicate with the water source W to receive water into each of the containers 14. As described above in connection with FIG. 2B, this method would require a means for opening a top end of the containers 14 in order to allow water to enter into a top end of the containers 14. In addition, the pump P pumps water into the reservoir 120. As shown, the water is ejected from nozzles 42 at different locations within the reservoir 120. In this embodiment, a closed reservoir 120 is utilized to permit mixing of ingredients before the ingredients are deposited in a cup 16. A valve 122 is positioned at a bottom opening in the reservoir 120. After all the liquid has entered the reservoir 120, the valve 122 opens to permit the ingredients and water to flow into the cup 16. The reservoir 120 could alternatively be a blender or mixer.

FIG. 2E is similar to FIG. 2B, but involves sequencing of the water flow in order to allow water to first flow through a first container 14, which houses the cocktail mixer, and then to flow through a second container 14, which has the alcohol product. This permits the alcohol to wash the interior of the funnel 18 on its way out. Valves 122 may be utilized in the fluid lines 138 to open and close the lines during the sequencing. Alternatively, the pump P can include valves for allowing water to pass through one line at a time. Other techniques are known for sequencing and could be utilized, as well. Alternatively, depending on the mixture inside the first pouch, water may be used to clean out the first pouch while water may not be used to clean out the second pouch.

FIGS. 3A-3D depict the use of a container 14 in the form of an aseptic bag or laminated pouch that is used to hold the ingredients. This type of bag is readily known in the packaging industry and is used for such things as juice boxes and other liquids. A first container 14 holds the alcohol and a second container 14 holds the cocktail mixer. While not shown, the containers 14 will be positioned in a receptacle 12 in FIG. 3A. The containers 14 shown are bottle shaped and the neck of the bottle is shown facing downwardly when installed in the receptacle 12. Other shapes could be utilized. For example a shape that is not direction specific could be used, if desired, such as a round, oval, rectangular, or other shaped pouch.

Figures 3A, 3B, 3C, 3D:
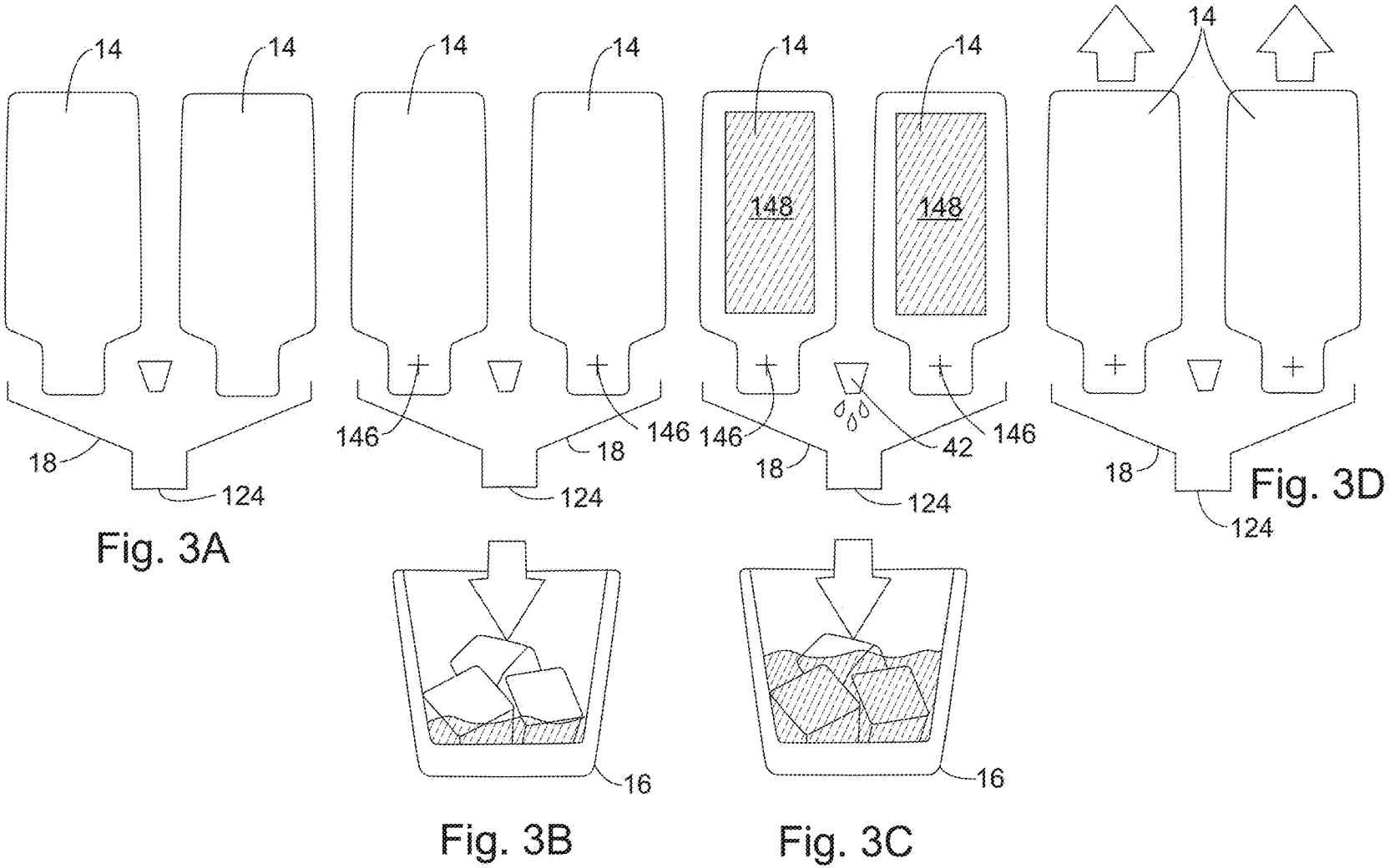
FIG. 3A depicts a schematic of dispensing according to FIG. 2A, 2C or 2E representing positioning the containers in the dispensing device.
FIG. 3B depicts a schematic of dispensing that occurs after FIG. 3A that involves cutting, slicing, or opening the containers.
FIG. 3C depicts a schematic of dispensing that occurs after FIG. 3B representing dispensing the ingredients into a glass.
FIG. 3D depicts a schematic of dispensing that occurs after FIG. 3C representing removing the containers from the dispensing machine.

In this example, the containers 14 are loaded into the device 10 in FIG. 3A. The container 14 is loaded into the receptacle 12 by hand. Once the containers 14 are positioned in the device 10, a cup 16 is positioned below a funnel 18 that receives liquid from the containers 14. Then an opening mechanism 40, such as a puncturing or cutting mechanism, is used to make an opening in the container 14. An opening 146 is shown being made near the bottom, front of the pouch 14, but could be made at other locations, such as at the end, rear, or side. In addition, the opening made could be a long slice through the container.

Some of the contents of the containers 14 may exit the container 14 upon contact of the container 14 with the opening mechanism 40. In some cases, the ingredients in the containers 14 will freely flow substantially entirely out of the containers 14 by gravity. This will in part depend upon the viscosity of the ingredients as well as the size of the opening 146 made in the containers 14 with the opening mechanism 40. In some cases, it may be beneficial to squeeze the contents of the containers 14 to ensure that the containers 14 are fully evacuated. This can be done at either FIG. 3B or FIG. 3C. Squeezing may occur by using pressure from the closing mechanism 24, or by using rollers (not shown), which are also typically applied with the closing mechanism 24. As discussed in greater detail below, the pouches 14 may advantageously substantially completely be drained of their ingredients. For example, 97% of the ingredients may exit the pouch by gravity after the pouch is cut open.

FIG. 3B shows a cup 16 placed under the funnel 18 so that when the opening mechanism 40 opens the containers 14, the liquid can fall through the opening in the funnel 18 into the cup 16. FIG. 3C shows the introduction of water into the funnel 18 for mixing with the ingredients from the containers 14. The spray from the water nozzle 42 can be directed, if desired, to make a swirling pattern in order to clean the funnel 18 after the ingredients have been emptied into the funnel 18. The spray from the water nozzle 42 can also be directed at the opening mechanism 40 in order to clean the opening mechanism 40. Multiple ports or nozzles 42 may be used for introducing water into the funnel 18.

FIG. 3C also shows a squeezing zone 148, which is a location on the containers 14 where pressure can be applied to the containers 14 by the closing mechanism 24 in order to squeeze the contents from the containers 14. Then the closing mechanism 24 is closed in FIG. 3B, forcing the contents of the containers 14 to empty. The device of FIG. 1 does not include a squeezing mechanism, but could be adapted to include a squeezing mechanism if desired.

FIG. 3D shows that the containers 14 can then be removed from the dispensing device 10 by pulling them out at their top end. The cutting mechanism may be removable for cleaning, if desired. The squeezing zone 148 could have a different shape from that shown and could encompass the entire surface of the container 14. Alternatively, the ingredients may simply evacuate using gravity.

Figure 4B:
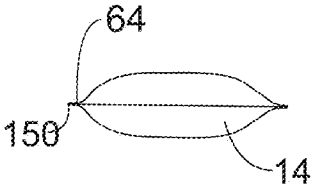
FIG. 4B depicts an end view of the flexible pouch of FIG. 4A.
Figure 4A:
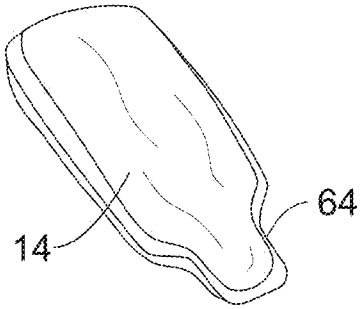
FIG. 4A depicts a perspective view of a first example container in the form of a flexible pouch.

FIGS. 4A and 4B depict the example container 14 shown in FIGS. 3A-3D. As discussed above, the container 14 is a bag or pouch that has a center seam 150. The seam 150 may be positioned in other locations if desired. Advertising indicia may be positioned on an exterior surface of the bag, if desired (not shown). The container 14 shown in FIGS. 4A and 4B has a rim 64 that is formed around the outer edges of the container 14. The container of FIGS. 4A and 4B may be a laminated pouch, among other known types of pouches.

FIGS. 3A-3D depict the containers 14 being positioned side-by-side. However, if desired, the containers 14 could be stacked against one another, or be positioned back-to-back, as shown in FIGS. 5-10. In the example shown in FIGS. 3A-3D where the containers are stacked instead of positioned side-by-side, a single opening or cutting mechanism 40 could be used to open both containers 14. Alternatively, multiple opening mechanisms 40 could be used, one on either side. Stacking of the containers 14 may also make the form factor of the device 10 smaller.

The cutting mechanism 40 and the water inlet 54 may cut the liner at substantially the same time, or one may activate before the other. A controller C or processor can be used to sequence the opening of a valve in order to introduce water into the containers 14. A controller C or processor could also be used to close the containers 14 in the receptacles 12 and to move the opening mechanism 40 into the containers 14, if desired. Alternatively, some of these functions can be done by hand or mechanically.

Figure 5:
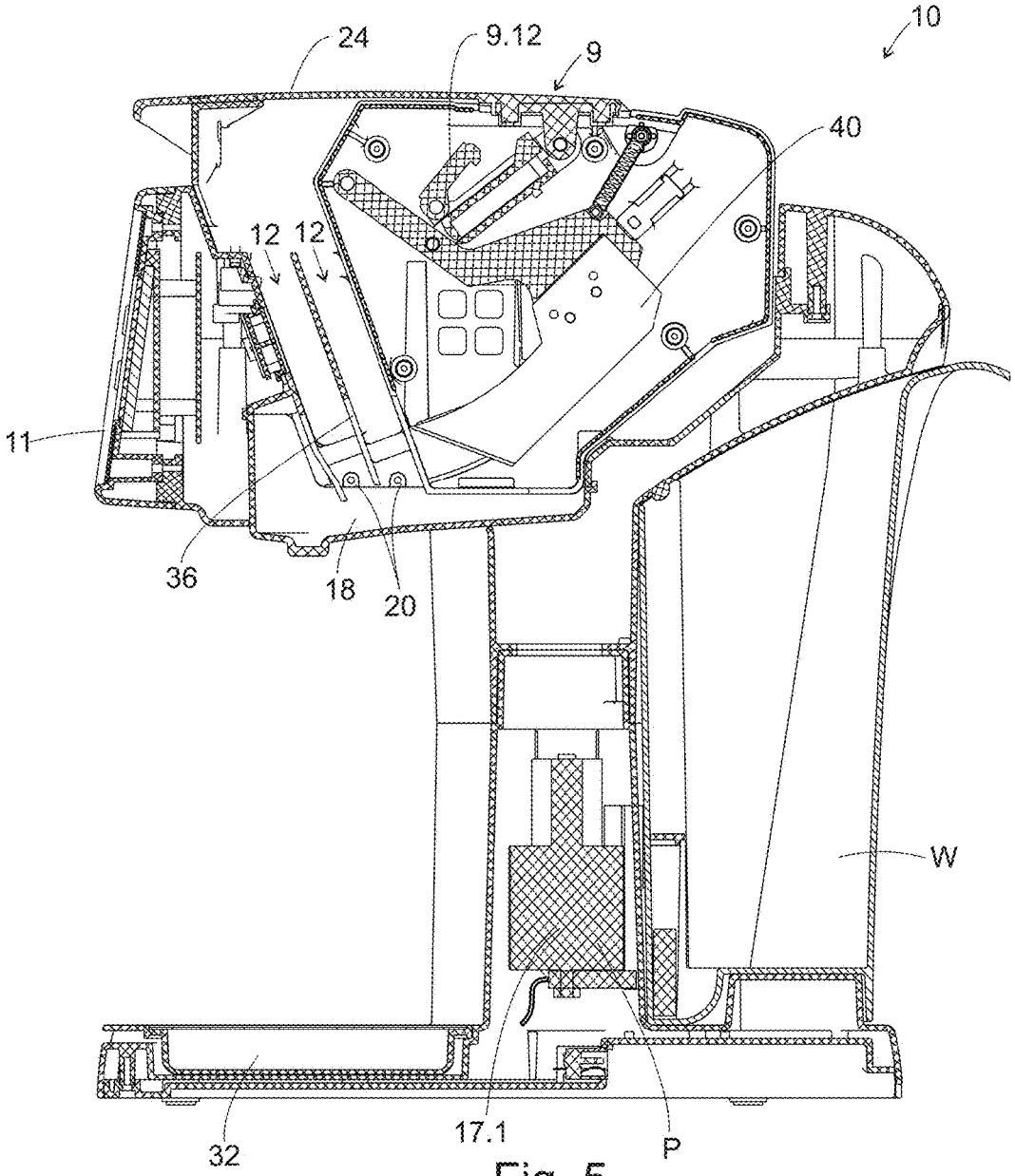
FIGS. 5-10 depict a sequence of operations for the beverage dispenser in order to slice open the beverage pouches positioned in the dispenser.
Figure 6:
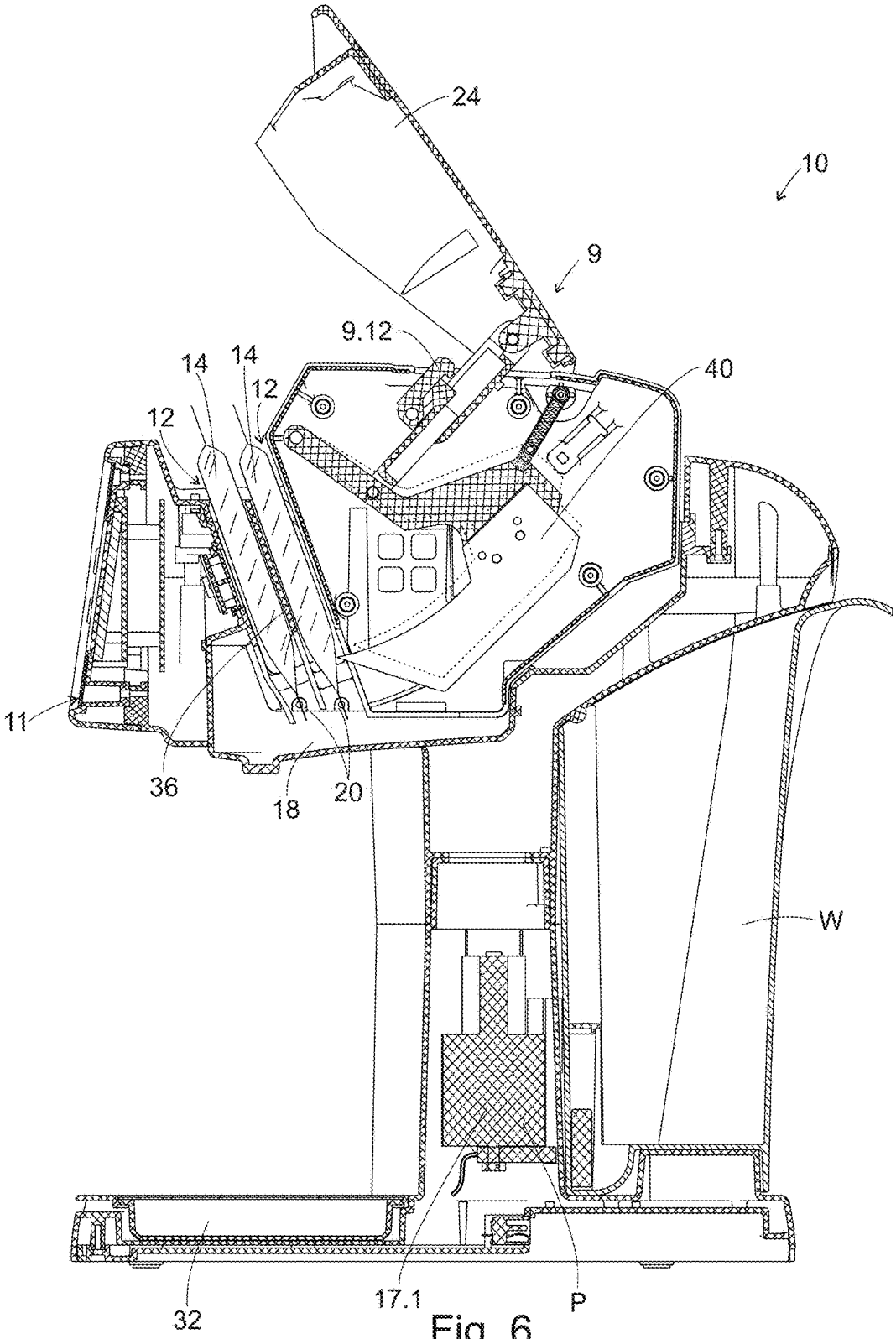

FIGS. 5-10 depict the operation of the device 10 through a full sequence that involves inserting the containers 14 and cutting them so that liquid can be dispensed. FIG. 5 shows the device with the cover 24 closed and without any containers 14 positioned in the receptacles 12. In order to use the device, the user opens the cover 24 and inserts containers 14 into the receptacles 12, as shown in FIG. 6. The cutter assembly 9 seats in the housing 22 adjacent the receptacles 12. In addition, a removable divider plate 36 is positioned in the receptacle slot 12 in order to delineate two separate receptacles 12. In some cases, where a larger pouch is needed to make a pitcher of cocktails, the divider plate 36 may be removed and a larger pouch inserted.

The cover 24 is connected to the cutter assembly 9 by a post 9.11 and a receiver 9.10. The post 9.11 is connected to the cutting arm 9.1 and cutting blade 40 and the receiver 9.10 is connected to the lower side of the cover 24 and is pivotable relative to the cover 24. A pawl 9.12 is positioned between the post 9.11 and the receiver 9.10 and is use to govern the motion of the cutting blade 40. The post 9.11 is slidably received within the receiver 9.10.

The housing 22 also includes a well 32 that has an overflow plate 34 that is positioned in the well 32 for catching any overflow from the dispenser 10. The well 32 is positioned at the dispensing end of the device 10 and is positioned below the funnel 18 through which liquid ingredients travel. The well 32 may include a drain lid 34 that is used for positioning a glass 16 on the drain 34 in order to keep the bottom of the glass 16 out of the well 32. Both the overflow well 32 and the drain lid 34 may be removable. The water reservoir W is removable in order to permit refilling of the reservoir with water.

FIG. 6 shows the blade 40 before it moves forward to slice the containers 14 and shows slight movement inwardly. The interior of the cutter assembly 9 includes a stop block 9.13, which stops the rearward movement of the cutting blade 40. The interior of the cutter assembly 9 also includes a spring 9.4 that is connected to the cutter arm 9.1. The spring 9.4 returns the cutter arm 9.1 to a non-extended position after cutting has occurred. The cutting blade 40 is connected to the cutter arm 9.1. The blade 40 is configured to rotate about an axis that is defined by the pivot point of the cutting arm 9.1 relative to the cutting assembly housing. The cutter arm 9.1 rotates about this pivot point when the cover 24 and post 9.11 move. A pawl 9.12 is used to lock the position of the post 9.11 relative to the receiver 9.10 such that when the cover 24 is closed, the post 9.11 is fixed in position relative to the receiver 9.10, thereby permitting the cutter arm 9.1 to rotate. FIG. 6 shows the cover 24 and pawl 9.12 before the pawl 9.12 is fully engaged. The pawl 9.12 must be fully engaged before cutting occurs.

Figure 7:
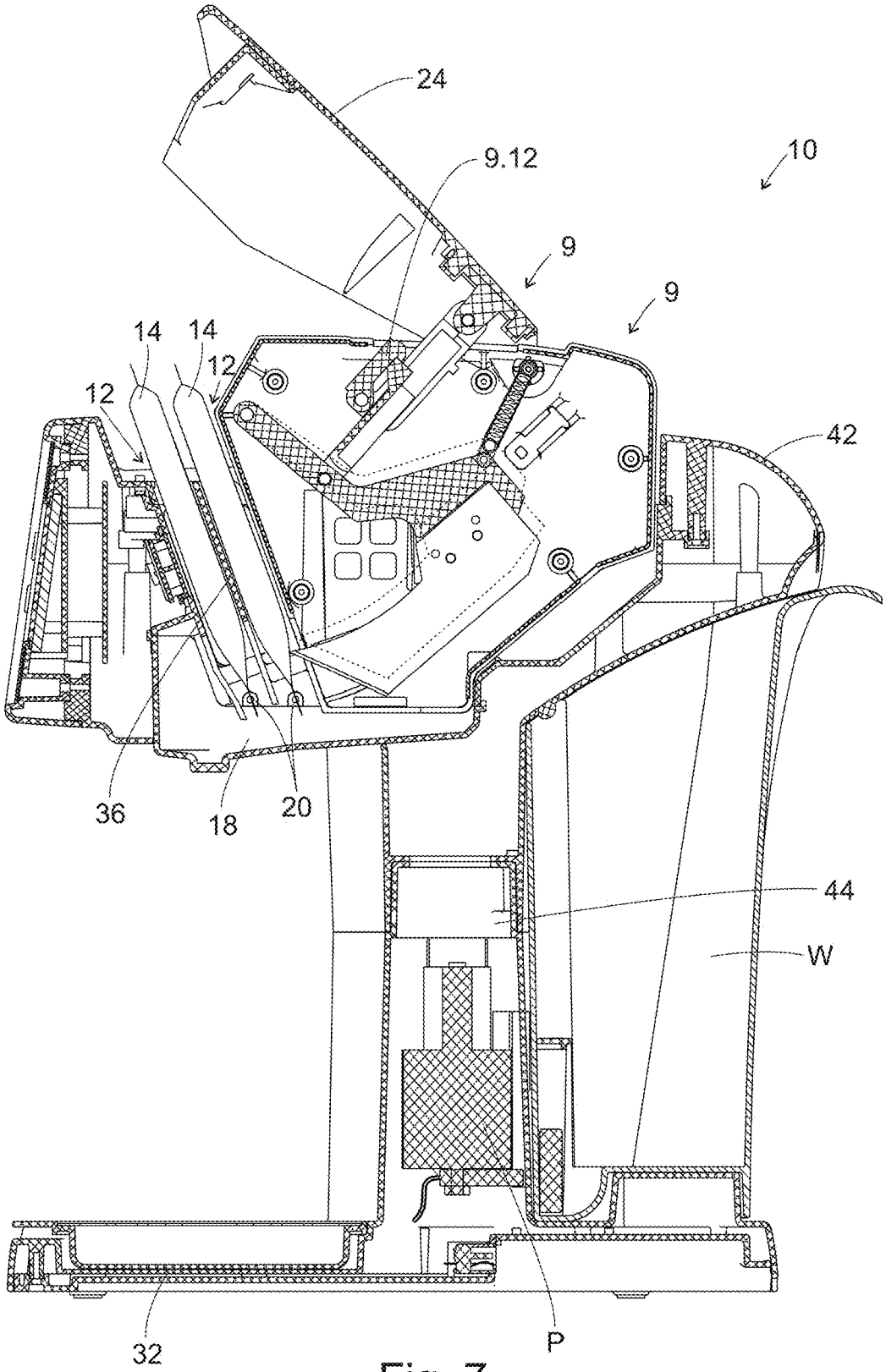
Figure 8:
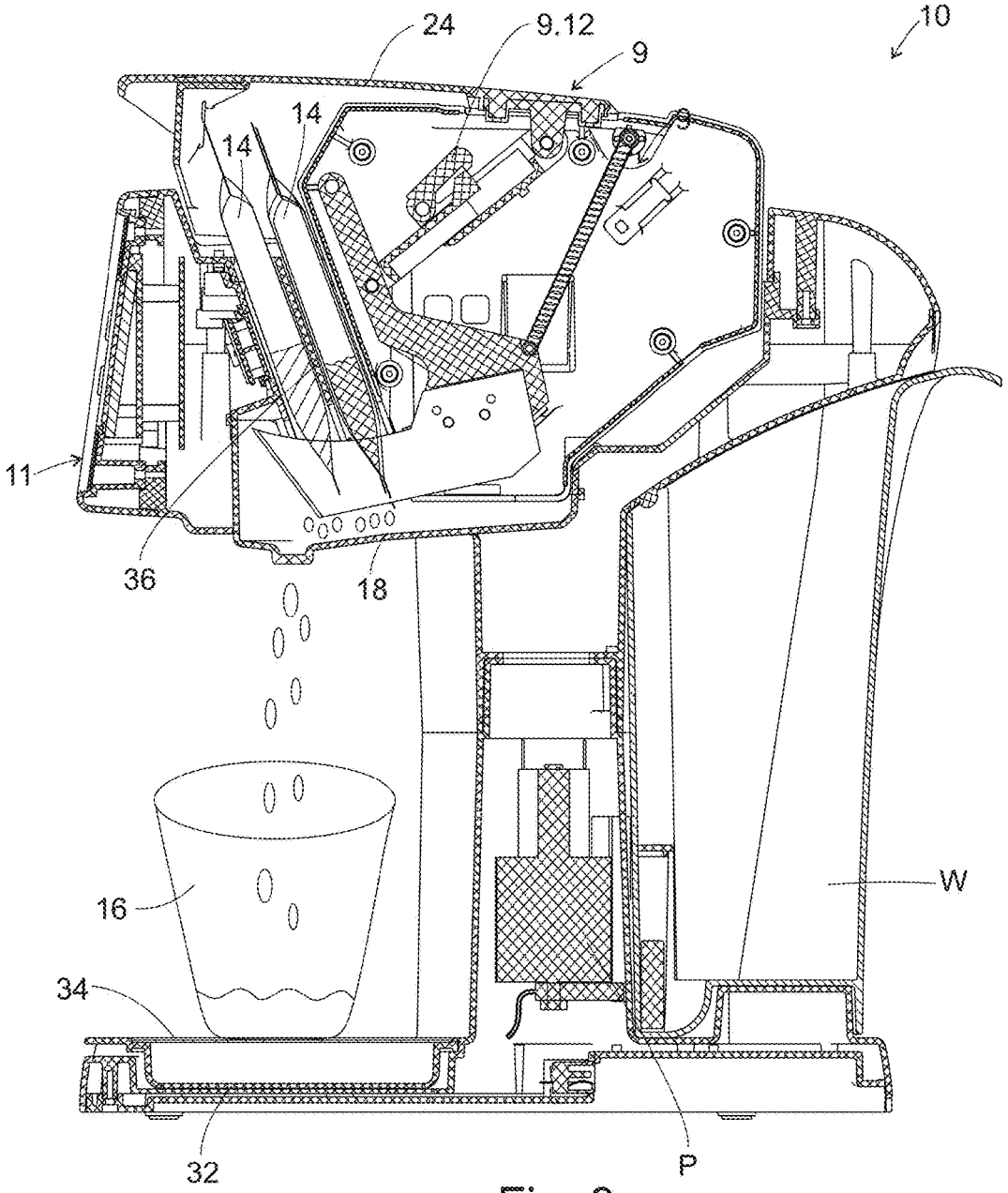

FIG. 7 shows the cover 24 and pawl 9.12 once the pawl 9.12 is fully engaged and locked in position, but before the cover 24 is closed. The pawl 9.12 engages a ledge 48 on the post 9.11 and seats on the ledge 48 until a knob 50 on the receiver 9.10 knocks an arm 56 on the pawl 9.12 off the ledge 48. In this position, when the user closes the cover 24, the post 9.11, pawl 9.12 and receiver 9.10 will act together against the force of the spring 9.4 to permit the blade 40 to travel forwardly in a substantially horizontal manner in order to cut open the containers 14 that are positioned in the receptacles 12 and to release the contents therefrom, as shown in FIG. 8. FIG. 8 shows the cutting assembly 9 after the blade 40 has traveled forward. In this position, the return spring 9.4 is fully extended and acts on the cutter arm 9.1 to pull it rearwardly after the pawl 9.12 is released. As is evident, the cutting blade 40 moves forward in a substantially horizontal movement. There is some vertical displacement during the movement, but a significant part of the movement is in a horizontal and forward direction. The movement is also a swinging movement since the pivot point for the cutter arm 9.1 is above the blade 40. The blade 40 has an angled, sharpened leading edge 60. The angled edge assists in initiating the cutting. An example of the containers 14, or pouches, are shown in greater detail in FIGS. 11-15.

As shown in FIGS. 11-15, the downwardly facing end of each pouch 14 includes a notch 62. A tip of the cutting blade 40 enters the containers 14 above this notch 62 and, because of the angle on the leading edge of the cutting blade 40, the blade 40 cuts downwardly as it travels forward until it cuts through the rim 64 of the containers 14. The notch in the containers 14 helps to remove material from the rim area 64 permitting easier cutting of the container 14. The area where the blade engages the container 14 is referred to as the "opening area". This area is defined as a function of the size and shape of the blade.

The blade 40 may be coupled to the cutter arm 9.1 in any known manner. The cutting blade 40 may be metal while the cutter arm 9.1 is plastic, or other suitable materials.

Figure 9:
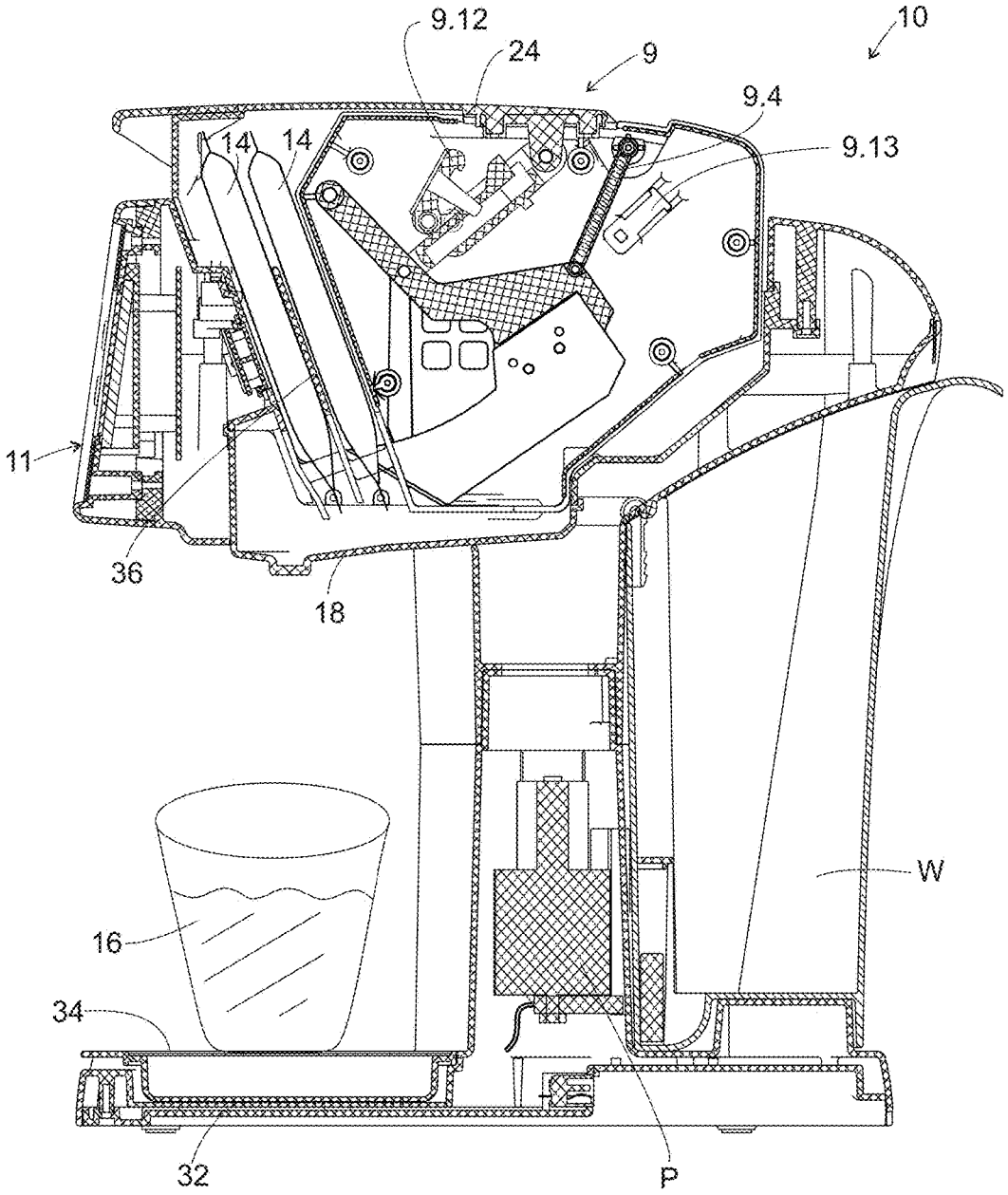
Figure 10:
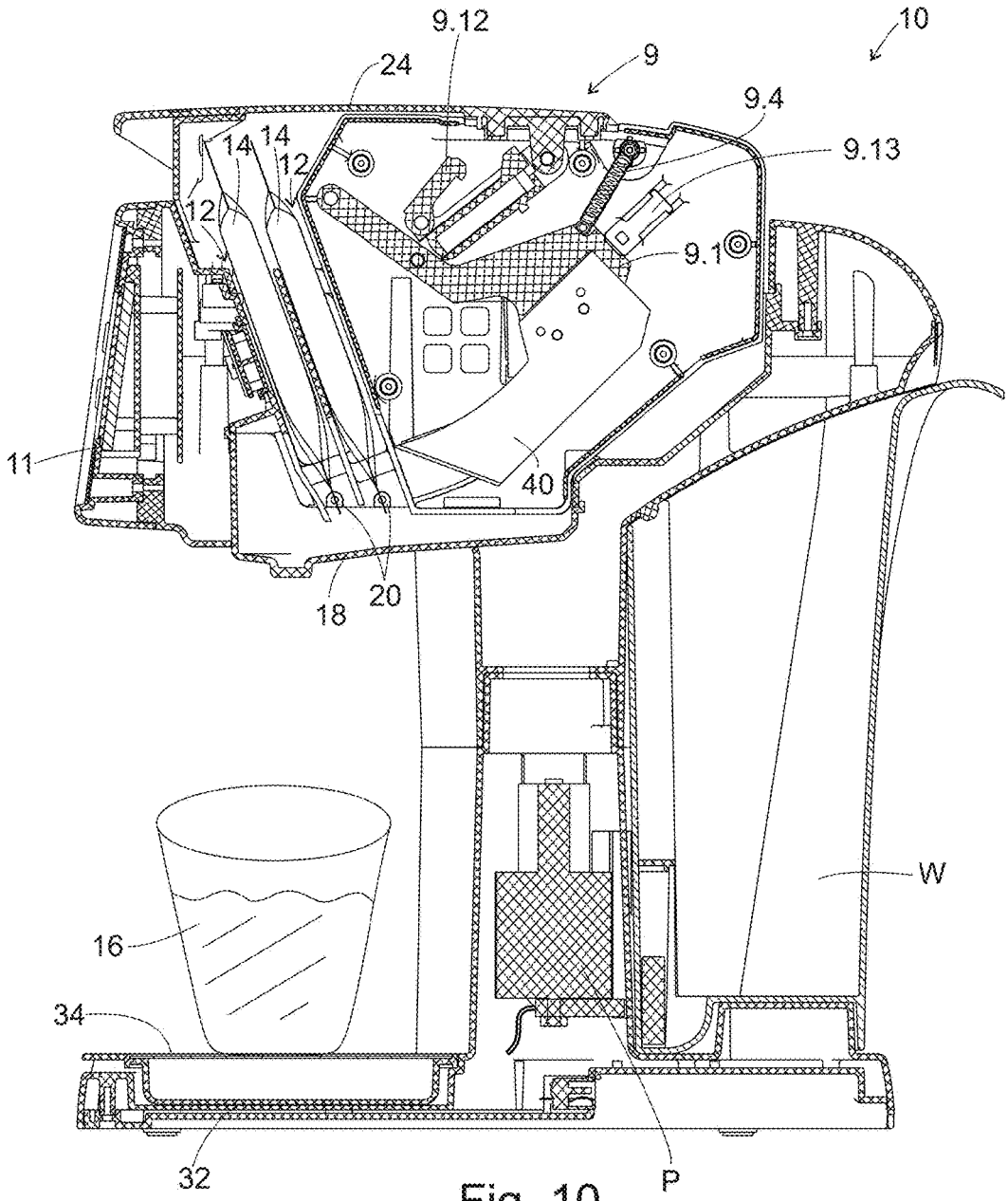
Figure 13:
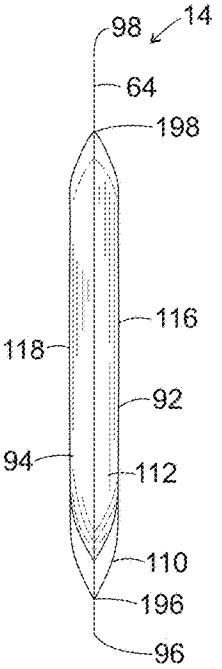
FIG. 13 is a side view of the pouch of FIG. 11.
Figure 12:
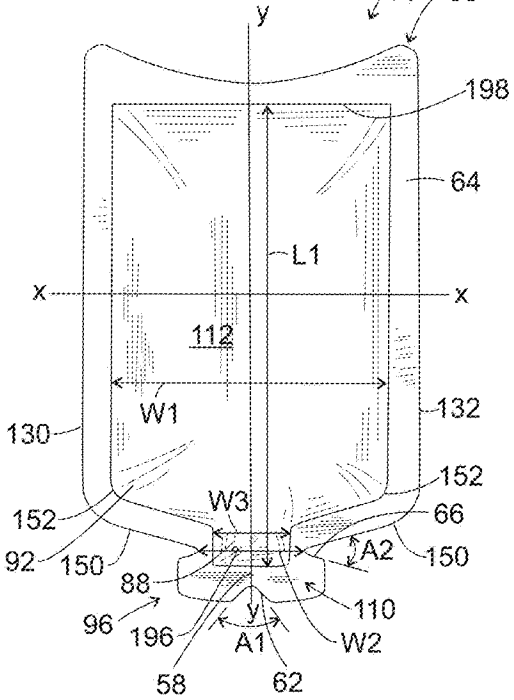
FIG. 12 is a front view of the pouch of FIG. 11.
Figure 11:
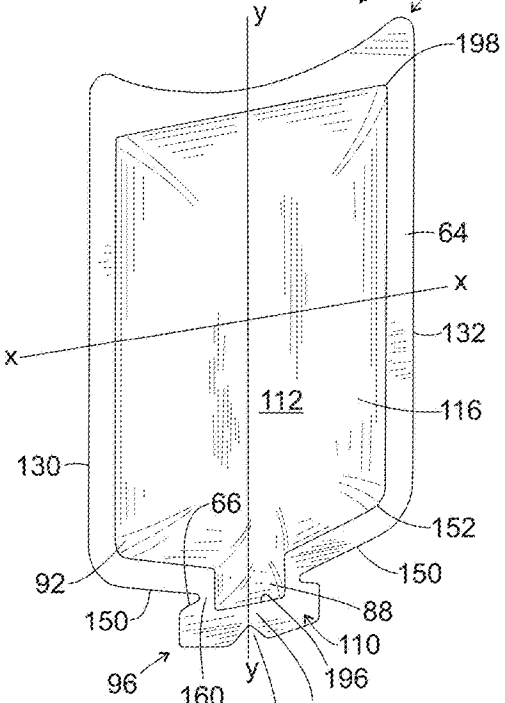
FIG. 11 is a perspective view of an example pouch for use with the beverage dispenser shown in FIGS. 1 and 5-10.
Figure 15:
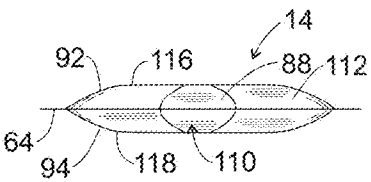
FIG. 15 is a top view of the pouch of FIG. 11.
Figure 14:
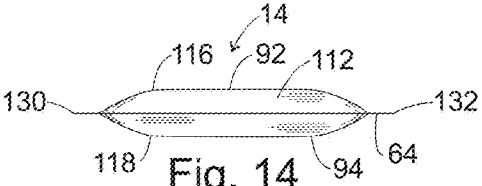
FIG. 14 is a bottom view of the pouch of FIG. 11.

FIG. 9 shows two positions for the cutting blade 40. A first position is before the cover 24 is closed, when the cutter arm 9.1 abuts the stop 9.13, and a second position shows the cutting blade 40 rotated slightly forwardly. This would occur as the cover 24 is closed. Because the pawl 9.12 locks the post 9.11 and receiver 9.10 together, when the cover 24 is closed, the post 9.11 and cutter arm 9.1 move forward. Since the cutting blade 40 is fixedly attached to the cutter arm 9.1, the blade 40 also moves forward in order to slice through both containers 14 simultaneously. The blade 40 travels through a slot 38 in the divider plate 36.

FIG. 9 shows the pawl 9.12 after it has begun to be released and rotated in order to permit the post 9.11 to move relative to the receiver 9.10. The return spring 9.4 is partially extended in this position and is in the process of pulling the cutting blade 40 rearwardly. Because the cutting blade 40 has already traveled through the opening areas of the containers 14, the containers 14 have substantially completely evacuated. There may be some residual liquid remaining in the containers 14 that is negligible. The return spring 9.4 will pull the cutter arm 9.1 rearwardly until a back end of the cutter arm 9.1 abuts the stop 9.13. In this position, the cutting blade 40 will be fully retracted, as shown best in FIG. 10. In addition, pawl 9.12 is in a fully disengaged position. The user must open the cover 24 in order to re-engage the pawl 9.12. Since the containers 14 at this point will be spent, they will need to be removed in order to permit a user to make another drink. The cover 24 will be opened and the containers 14 can be pulled out of the receptacles 12 and disposed of.

The example drink dispenser 10 takes multiple containers 14 of material, adds water and dispenses them into a cup 16. The funnel 18 serves as a mixing chamber for the ingredients in the containers 14, as well as a station for mixing water with the contents of the containers 14. Water nozzles or outlets 20 are provided at the bottom of the receptacles 12. The water outlets 20 are coupled to a pump 17.1 and the water reservoir W and are used to mix water with the contents of the containers 14. In addition, the water outlets 20 are used to help clean and rinse the funnel 18 and the various parts within the interior of the device 10 without having to remove the cutting assembly 9 or divider plate 36. The water outlets 20 are positioned on both sides of each receptacle 12. They work together to create a swirling pattern within the funnel 18 in order to help mix the ingredients and to help clean the interior when no containers 14 are inserted.

As discussed above, the display 11 includes a button for "mix" 10.5 and "clean" 10.3. The "mix" button 10.5 is pressed after the cover 24 is closed in order to dispense water from the water reservoir W. The "mix" button 10.5 is tied to a control system that will meter an appropriate amount of water for the particular containers 14 used. The mix button 10.5 may also be tied to a read function 10.2 such that upon reading the type of container 14 used, the control system can determine how much water to add.

A "read" button 10.2 can be used to read the types of pouch or pouches inserted and can be used to instruct a user as to what type of alcohol pouch to insert when a mixer pouch is installed. This read function would occur separately from the MIX button. Alternatively, button 10.2 can be an INFO or HELP button that the user presses, when needed in order to get instructions on how the machine works. It is anticipated that, due to the simplicity of the machine, once the user makes one or two drinks, they will no longer need instructions.

Reading may occur automatically when the user presses MIX, or, in some cases, the MIX and READ functions may be separated. In addition, once the reading occurs, the control system knows what type of beverage is being made and can determine how much water to add to the system. In one embodiment, the read 10.2 and mix 10.5 functions are both performed by the MIX button.

The "clean" button 10.3 is pressed when no containers 14 are present in the receptacles 12 in order to rinse or clean the interior of the device with water. The CLEAN button 10.3 initiates a flow of water into the funnel 18 that permits the funnel 18 to be rinsed out. Thus, a user must position a cup 16 under the funnel 18 when using the CLEAN button 10.3. In addition, the cutter assembly 9 and divider plate 36 are removable from the housing 22 and permit a user to easily clean the internal parts of the device 10 that come into contact with ingredients. Both parts maybe submerged in hot soapy water in order to be cleaned. In addition, once the divider plate 36 and the cutter assembly 9 are removed, a user can wipe the interior of the machine by hand in order to clean out the interior of the machine. The cutter mechanism may have a locking mechanism to prevent or deter release of the cutting blade when the cutter mechanism 9 is removed from the housing 12.

The pouch 14 can be made of PET, Polypropylene, Polystyrene, PETG, Surlyn, and HDPE food-grade materials or other materials. The seal 52 could be a foil seal or could be other types of materials, including any number of polymeric materials or combinations of materials in layers. The liner may comprise a combination of materials in layers. The seal 52 can be hermetic in order to preserve product freshness and shelf life and have inner layers that promote freshness and shelf life. While the liner is described as being vacuum sealed, it could be applied in other manners as known by those of skill in the art.

A nozzle 42 can be used for directing the water at one or more locations within the funnel 18 or reservoir 20. The water is metered out to mix with the contents of the containers 14 in a fixed amount in order to make the "perfect" drink. In addition, the water helps to clean the reservoir 20 each time a drink is made, since it may exit the reservoir 20 after the contents of the containers 14 have existed the reservoir 20.

The pouch 14 utilized with the dispenser stores a liquid, such as a concentrate, a non-concentrate, a flavor, an alcoholic beverage, a spirit, another beverage component, or the like. The pouch 14 is designed for use in a drink machine that incorporates a cutting blade that slices the pouch longitudinally in order to open the pouch. The pouch is positioned in the dispenser vertically and the cutting blade cuts the pouch at a lower end, although it could cut the pouch along its entire length or a greater amount of its length than shown. When the pouch is cut with the cutting blade at the lower end of the pouch, the pouch substantially completely evacuates the contents of the pouch. For example, approximately 90-100% of the pouch is evacuated. In another embodiment, approximately 92-98% of the pouch is evacuated. In another embodiment, approximately 93-97% of the pouch is evacuated. The amount of evacuation may be 85%, 90%, 92%, 93%, 94%, 95%, 96%, 97%, 98%, 99%, or substantially 100%. The pouch 14 could alternatively be used without a drink machine and could be opened by hand by tearing or cutting through part of the pouch 10, as will be described in greater detail below.

A pouch was previously discussed in connection with FIGS. 4A and 4B. The pouch 14 in FIGS. 4A and 4B is similar to the pouch presented in FIGS. 11-15 in that it is laminated. The shape is also similar in that the pouch is a fully flexible pouch 14 that has a necked down portion at one end. This necked down end can be referred to as a spout 110 and is formed at the top of the pouch 14, but is inserted into the dispenser 10 facing downwardly.

Another example pouch 14 is shown in FIGS. 11-15. The pouch 14 is a fully flexible pouch, meaning that there are no hard plastic parts associated with the pouch. The pouch 14 has an inner compartment 112 and an outer, sealed edge that forms a rim 64. The pouch 10 is formed from a front layer 116 and a back layer 118. As discussed in greater detail below, the front and back layers 116, 118 may be formed from two separate sheets, or from a single sheet of material that is folded over or shaped as a tube. The front layer 116 has an inner and an outer surface and the back layer 118 has an inner and an outer surface. A space is provided between the front and back layers 116, 118 to form a compartment 112 between the inner surfaces of the front and back layers. The compartment 112 forms a space for accommodating a liquid or slurry for storage therein. The perimeter of the pouch 14 is sealed entirely around the outer perimeter. The sealing process is known in the art and creates a seam or rim 64. The pouch 14 may be hermetically sealed.

While the example pouch 14 shown does not have bottom wall, the pouch 14 could be formed as a standup pouch and include a bottom wall, if desired. The pouch 14 could also alternatively or in addition thereto have a top wall, or be shaped differently, such as having a gusset around the entire front and back surface 116, 118 (not shown). If desired, the pouch could be formed without a rim 64. As is evident, any type of soft pouch can be used, as long as the end that engages with the cutting mechanism is capable of being cut by the cutting mechanism. The term "soft" pouch refers to a flexible pouch that is cutable, pierceable, or sliceable with a knife and that otherwise does not have any hard plastic or other attachments in the vicinity of the area of the pouch that is to be cut, e.g., the opening area.

The general shape of the pouch 14 is rectangular with a spout 110 at an upper end. The pouch 14 has a longitudinal axis Y-Y that extends along the long axis of the pouch 14. The pouch 14 also has a transverse axis X-X that is perpendicular to the longitudinal axis Y-Y. During use, the longitudinal axis Y-Y of the pouch 14 will be positioned substantially vertically. The pouch 14 has a front outer surface 92 and a rear outer surface 94. The shape of the front outer surface 92 matches the shape of the rear outer surface 94, although it's possible for the front outer surface 92 not to match the rear outer surface 94, and such a pouch is within the scope of the present invention. For example, if one side of the pouch were bowed outwardly more than the other side, the front outer surface 92 would not match the rear outer surface 94. The perimeter of the pouch 14 is cut simultaneously after the pouch 14 is sealed in order to form an outer boundary to the pouch 14. The pouch as a top end 96 and a bottom end 98.

The compartment 112 has a top edge 196, a bottom edge 198, a left and right side edge 130, 132, which may be substantially identical to one another, and a front and rear surface 116, 118, which are shown as being substantially identical to one another in shape, but could be different from one another. A narrowed portion 88 of the compartment 112 is positioned at the top edge 196 of the compartment 112 in the area of the spout 110, and the bottom edge 198 of the compartment is flat or straight. An upper edge 196 of the compartment 112 is substantially an inverted V-shape when viewed from the side of the pouch 14. The upper edge 196 formed by the joining of the front and rear sides and forms shoulders 152 adjacent the spout 110 and narrowed portion 88. The compartment 112 has a length L1 that is greater than a width W1 thereof, although the length could be less than the width, if desired.

The rim 64 of the pouch 14 is formed from the front and back layers 116, 118, which are joined together around the outer edge by heat sealing or other known techniques for forming pouches that contain a liquid. The rim 64 has a top end 96, a bottom edge 98, a left and a right side 130, 132, which are substantially identical to one another, and a front and a back surface 116, 118 which are shown as being substantially identical to one another in shape, but may have different graphics applied thereto. The top end 96 of the rim 64 includes a spout 110 into which the narrowed portion 88 of the compartment 112 extends. The spout 110 is approximately rectangular in profile, but could have other shapes.

The bottom edge 98 of the rim 64 has an inwardly curved or concave edge. The spout 110 has a top edge 96 and the top edge 96 of the spout 110 has a curved surface, which may have a convex edge. The bottom concave shape and the top convex shape of the pouch rim 64 may be complementary to one another, such that they are substantially identical or created by the same cutting tool, such as a die punch. Other shapes could also be used for the top edge 96 of the spout 110. The side edges 130, 132 of the rim 64 are straight, but could be other shapes. The rim 64 also includes an upper edge 150 that slopes downwardly to form shoulders 152. The upper edge 150 of the shoulders 152 joins with the spout 110, which is centrally located. The shoulders 152 are shown as rounded portions where the side edges 130, 132 meet the upper edges 150 of the rim 64, but could be other shapes, such as squared.

The spout 110 includes two necked-in cut outs or notches 66, one on each side of the pouch 14, that are positioned between the spout 110 and the adjacent upper edge 150 of the pouch 14. These necked-in cut outs 66 help to create the narrowed portion 88 of the spout 110 that can be used to assist in tearing the spout 110 open by hand.

The pouch 14 also includes a notch 62 that extends longitudinally downwardly and inwardly at the top edge 96 of the spout 110. This notch 62 is used to create a thinned portion 58 of the spout 110 to aid in cutting the pouch 14 with the cutting blade 40 that is positioned inside a drink dispenser 10. It is contemplated that a cutting blade 40 will enter the front or rear surfaces 116, 118 of the pouch 14 and slice downwardly or upward longitudinally Y-Y. The notch 62 is designed to aid in the guiding of a blade through the spout 110 of the pouch 14 in order to release the contents of the pouch 14 therefrom and to permit the contents of the compartment 112 to substantially fully evacuate by gravity.

In practice, the top end 38 of the pouch 14 will be inserted into a receptacle in a drink machine such that the top end 96 faces downwardly and the bottom end 98 faces upwardly when the pouch 14 is installed in a slot of the dispenser 10. A cutting blade 40 enters from the front or rear surfaces of the pouch 14 and slices the pouch 14 vertically through the front and/or rear surfaces 116, 118 of the pouch 14 and spout 110. The blade 40 may be directed along part of its travel towards the notch 62 in the pouch 14 since that area of the pouch 14 has a thinner rim 64. Thus, the notch 62 helps to promote cutting in a desired location of the pouch 14.

The pouch 14 dimensions are, in part, determined based upon the types of manufacturing machines presently readily available. As other manufacturing machines become available, the pouch 14 size and shape may vary. In addition, although the compartment 112 mimics the shape of the rim 64 of the pouch 14 (with the exception of the bottom edge 198), the compartment 112 could have a shape that is different from that of the rim 64.

The notch 62 on the top end 96 of the pouch 14 can be formed with an angle A1 of about 90 degrees. The notch 62 could have other dimensions than shown and described. The necked in cut outs 66 that form the tear location in the spout 110 could be formed at an angle A2 of about 50 or 60 degrees. The cut outs 66 could have different dimensions than shown and described. The cut outs 66 of the spout 110 form a thinner area 160 of the rim 64, making it easier to remove the spout 110 from the remainder of the pouch 14 by tearing or cutting. The indented notch 62 on the top edge 96 of the pouch 14 also defines a thinned portion 58 at the top end of the pouch 14 for cutting, as previously discussed.

As shown in FIGS. 11-15, the compartment 112 has a thickness that can vary based upon how much contents are required in each pouch 14. One exemplary thickness is about 11 mm. A length L1 of the pouch 14 may be about 139 mm while a width W1 may be about 82 mm. The width W2 of the spout 110 may be about 35 mm and the width of the narrowed portion 34 of the compartment 112 may be about 20 mm. The width W3 of the narrowed portion 34 of the spout 110 may be about 25 mm. The convex top edge 96 and concave surface 98 at the bottom edge of the pouch 14 may be about R70. The angle of the top shoulders 152 of the pouch 14 relative to the transverse axis X-X may be about 15 degrees. The thickness of the rim 64 at the narrowest point at the bottom edge 40 may be about 5 mm. The shoulders 152 may have a radius of about R12. Depending on the shape of the pouch that is utilized, these dimensions may be substantially the same, similar, or completely different.

One example pouch is a lamination of PET, foil, and polyethylene. Other types of flexible materials may also be used, if desired. The invention not being limited to a particular type of material unless required to be so limited by patents of another.

Figure 16:
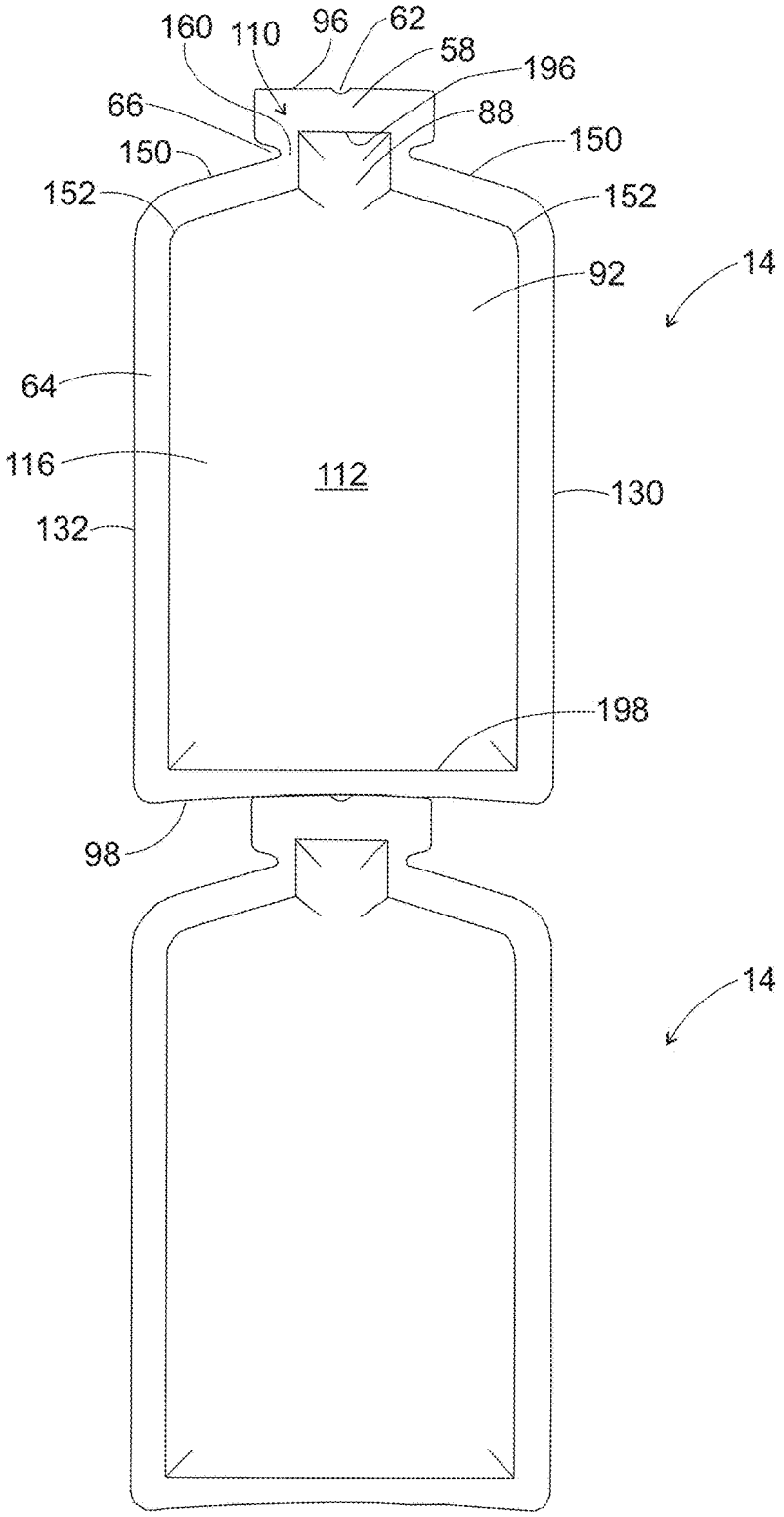
FIG. 16 is a front view of another example pouch on a production line showing the pouches a position after being die cut apart.

FIG. 16 depicts another example pouch 14 on a production line after the lamination has been cut and filled. The example pouches shown in FIG. 16 have lesser convexity on the top edge 96 and less concavity on the bottom edge 98 than the pouches shown in FIGS. 11-15, but otherwise are similar to the pouches shown in FIG. 11-15. The pouch shown has a greater radius along edge 98. As is evident, other sizes and shapes of pouches may work with the example beverage dispenser, as long as the pouches fit in the slots in the dispenser and are of a soft, sliceable material that permits cutting with a cutting blade.

As shown in FIG. 16, the compartment 112 has a thickness that can vary based upon how much contents are required in each pouch 14. One exemplary thickness is about 11 mm, 10 mm, 12 mm, or 13 mm. A length L1 of the pouch 14 may be about 139 mm while a width W1 may be about 82 mm. The width W2 of the spout 110 may be about 35 mm and the width of the narrowed portion 34 of the compartment 112 may be about 20 mm. The width W3 of the narrowed portion 34 of the spout 110 may be about 25 mm. The concavity of the top edge 96 and concave surface 98 at the bottom end of the pouch 14 may be about R270. The angle of the top shoulders 152 of the pouch 14 relative to the transverse axis X-X may be about 15 degrees. The thickness of the rim 64 at the narrowest point at the bottom edge 40 may be about 5 mm. The shoulders 152 may have a radius of about R12. Depending on the shape of the pouch that is utilized, these dimensions may be substantially the same, similar, or completely different.

While not shown, four pouches could be utilized instead of two, with two pouches being stacked on top of each other in each receptacle 12. Alternatively, a single pouch could be used at any given time. In this case, the user could add alcohol via a premeasured shot glass that can be provided with the dispenser. If the user wishes a lighter drink, they could partially fill the shot glass. If the user wants a "double", they could pour more liquor into the glass 16.

The containers 14 could be positioned in their respective receptacles or slots 12 and the closing of the cover could serve as the activation signal for opening the containers 14. The cover could be closed and pressed downwardly to activate the device 10. Alternatively, a separate button could be pressed to activate the device 10, such as the MIX button previously discussed. The contents of the container 14 are drained and water is added, which rinses the funnel 18.

The opening mechanisms 40 may be a cutting or slicing member(s), or other known members for opening a container 14. A piercing mechanism could be used, as long as the piercer is positioned to allow substantially all the contents of the pouch 14 to be evacuated. The opening mechanisms 40 are selected as a function of the type of containers 14 used to hold the ingredients. If one or more opening members are used, they each may be the same or different from one another.

The device 10 may be a counter-top machine that allows 2, 3, 4 or more liquids/slurries to mix together in specific ratios (minimizing liquid components to keep carbon footprint of the mixed drink at a minimum). A water source W may be a water reservoir W that is refillable and part of the device 10. A tank of any size, such as 32 ounces, may be utilized as the water reservoir W. Alternatively, the device 10 could be connected to a water line so that the water reservoir is not needed.

The container sizes and shapes may vary from that shown here and relative to one another in use. One example pouch may have a size of 1-2 ounces, such as 1.6 ounces or 1.7 ounces. Because alcohol is closely regulated by the federal government, the alcohol pouch may have 1.7 ounces of alcohol. Alternatively, where different laws allow for it, the pouch could hold 1-2 ounces or 1-3 ounces of alcohol. The pouches may hold concentrated ingredients. As such, the size of the pouches or containers may be reduced. For example, a 2 ounce pouch of orange juice concentrate may make 8 ounces of juice when properly re-constituted. Examples of types of components that may be used in making a cocktail using the device 10 include the following, which represent different viscosities: Syrup, Alcohol, Juice/Juice Puree, Dairy, a combination thereof, or other components not mentioned.

The dispensing device 10 is compact and stylish. The dispensing device 10 is easily cleaned/maintained. A separate container may be added to the first and second containers 14 to provide a carbonating component. Alternatively, a separate carbonation system may be utilized along with flavoring and alcohol containers 14. A CO2 container may be used for purposes of carbonation, if desired.

The dispenser 10 may be used to make any number of different types of cocktails. Examples of types of cocktails include those presented at http://www.drinksmixer.com/cat/1/ (12000+ cocktail recipes). As an example, one type of cocktail that may be made with the device 10 is "Sex on the Beach," a popular fruit mixed drink made of vodka, peach schnapps, creme de cassis, and orange and cranberry juices. An individual container 14 for "Sex on the Beach" may be input to the system as well as a "shot" container 14 that includes a combination of vodka, peach schnapps and crème de cassis. Alternatively, the "Sex on the Beach" container 14 may already include all the components with the exception of vodka, which may be input using a separate shot container 14.

Alternatively, separate receptacles 12 for receiving multiple components may be used, or containers 14 may be sized to seat on top of or stacked against each other, with the opening or piercing member piercing through all containers 14 in the receptacle 12 in order to permit water to flow through each of the containers 14, or for the containers 14 to drain via gravity, in order to permit multiple different types of alcohol to flow from a single or multiple receptacles 12. For example, a single receptacle 12 could house the "Sex on the Beach" non-alcoholic components while a second single receptacle 12 could house the alcohol components including a peach schnapps container 14, a crème de cassis container 14, and a vodka container 14. The alcohol components could be stacked on top of each other or otherwise arranged in the receptacle 12. The alcohol components could be the same size or different sizes, depending upon what is called for in the drink recipe.

Another type of cocktail that is well known is the "Gin Fizz". A Gin Fizz uses gin, lemon juice, soda water, and gomme syrup. In this example, one receptacle 12 would receive a container 14 of Gin and the other receptacle 12 would receive a mixer container 14 that contains lemon juice and gomme syrup. A separate input can provide the soda water—either added external to the device 10, such as by pouring soda water into the removable cup 16, or via a separate carbonation unit that permits the dispensation of carbonated soda water to the system. Where a separate carbonation system is used, the water may flow from the reservoir into the carbonation system where it is carbonated. Then, carbonated water may either flow through the pouches or containers 14, or flow separately to the cup 16. In one example, uncarbonated water travels through the pouches and containers 14 to dispense them into the cup 16, while soda water travels separately to the cup 16.

Ice dispensing may be provided by an auxiliary device (not shown) that is either integral with or separate from the device 10. The device 10 may include a refrigeration component (not shown) in order to chill or cool the components rapidly during the dispensing process. The device 10 may include a sensory signal to indicate that the products are being mixed together during dispensation.

Although an initial embodiment of the beverage maker 10 is an on the counter-type device, the device 10 may alternatively be an on-the-floor device or have different sizes depending upon the application. The beverage maker 10 may be utilized at home, in hotels, or anywhere where cocktails are imbibed.

The device 10 may include smart technology, such as an RFID chip reader and a processor and/or controller C for directing the operation of the device 10. The containers 14 may include a chip, such as an RFID chip that includes instructions for the device 10 to make the cocktail properly. For example, the chip may include instructions for how much water to add to the contents of the pouch, whether to use plain water or carbonated water, or a combination of both, how much pressure to apply to the contents of the container 14, or other instructions that aid in properly preparing a cocktail. A chip reader reads the instructions from the chip when the container 14 is placed into the receptacle 12. These instructions are then communicated to the processor, which then instructs the various parts of the device 10 to operate according to the instructions. The device 10 may include a processor and/or controller C regardless of whether RFID technology is used in order to allow for proper operation of the device 10. Other ways, such as barcodes, may be used in order to send instructions from the pouch to the processor, as known by those of skill in the art.

The device may use a barcode reader or similar device in order to read a code or image that is positioned on an exterior of the pouch. This image or bar code can be read and transmitted to a controller, which has programming that permits different amounts of liquid to be added to the cup 16 based upon the type of ingredients in the pouch 14.

Other types of containers 14 or shapes of containers 14 may be used, including those having different openings.

Various parts of the device 10 can be transparent, including the containers 14, if desired. Advertising material and instructions may be positioned on the containers 14 and on the devices 10.

In one embodiment, a beverage dispenser includes a housing, a first pouch, a cutting mechanism, a water source, and a pump. The housing has at least a first receptacle. The first pouch has a beverage content for seating in the first receptacle and has an opening area thereon for opening the pouch. The cutting mechanism is for opening the first pouch in the opening area of the pouch in order to allow the contents thereof to evacuate from the pouch. The water source is coupled to the housing permitting water to mix with the contents of the pouch. The pump is coupled to the water reservoir for transferring water from the water reservoir to the vicinity of the first receptacle such that water from the water reservoir is permitted to mix with the contents of the pouch. The opening area of the pouch permits cutting or slicing of the pouch with the cutting mechanism.

The pouch may be made of a soft, flexible material and the opening area of the pouch may include at least part of a side surface thereof. The pouch may be substantially completely evacuated after being cut by the cutting mechanism. About 90-99% of the contents of the pouch may be evacuated by gravity after the pouch is cut by the cutting mechanism. The cutting mechanism may be a blade.

The beverage dispenser may also include a control system for operating the beverage dispenser in order to dispense a beverage from an outlet of the housing. The beverage dispenser may also include a control panel permitting a user to enter instructions to the control system.

In another embodiment, a pouch for use in a beverage dispenser includes a soft pouch having a liquid or slurry contents stored in at least one compartment thereof and having a shape and size to seat in a receptacle of a beverage dispenser in order to allow opening of the pouch within the dispenser such that the contents of the pouch may be evacuated. The pouch is formed of a laminated material.

The laminated material may be a combination of PET, foil and polyethylene. The pouch has a length, a width, a top edge, and a bottom edge. The length may be greater than the width, and the top end may include a necked-down portion. The bottom edge may be concave. The top edge may be convex.

In another embodiment, a pouch for use in a beverage dispenser includes a first layer, a second layer, and an opening area. The first layer and second layer together form a cavity for holding a liquid or slurry content there between. The opening area on one or both of the first and second layers is configured to permit a cutting blade to slice through one or both of the side and top end of the pouch in order to permit the contents to be substantially completely evacuated from the pouch via gravity.

The first layer and the second layer may be coupled together via sealing in order to form a rim around a perimeter of the pouch. The entire pouch may be made of a flexible, sliceable material. The pouch may have an opening area defined on at least one surface thereof that accepts a cutting blade in order to open the pouch, and the opening area is soft, flexible, and sliceable. One or both of: the opening area may comprise less than one half of the length of the pouch; and the opening area may comprise an area that is less than one half the width of the pouch. The first and second layers may be integral with each other. For example, the first and second layer may be formed from a single sheet of material and folded over on itself.

The pouch has a length and a width. The length of the pouch may be greater than the width. The pouch may be configured to seat in a beverage dispenser lengthwise such that the length extends vertically permitting a cutting mechanism to slice through the opening area. The contents of the pouch may evacuate the pouch via gravity.

In another embodiment, a method for making a mixed drink using a drink dispenser and the pouch described above includes depositing the pouch having a liquid or a slurry content into a receiving receptacle of the drink dispenser. Then the method includes engaging a cutting mechanism that is positioned inside the drink dispenser to cut through at least a part of a side wall of the pouch in order to permit the contents of the pouch to at least in part exit the pouch and drain into a container. Then the method includes pumping water from a water reservoir to mingle with the contents from the pouch and to drain into the container.

The pouch may be substantially completely evacuated via gravity after engaging with cutting mechanism.

The term "substantially," if used herein, is a term of estimation.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A pouch for use in a beverage dispenser comprising:

a soft pouch having liquid or slurry contents stored in at least one compartment thereof and having a shape and size to seat in a receptacle of a beverage dispenser in order to allow opening of the pouch within the dispenser such that the contents of the pouch may be evacuated, with the pouch having only a front panel and a rear panel, with the front and the rear panels being joined together by a common seal around their entire outer peripheries to form a single continuous rim that defines between the front and rear panels the at least one compartment, with the pouch having a convex top edge defined at the outer periphery of the top end thereof;

wherein the front and rear panels are formed of a laminated material; and the entire rim of the pouch remains intact prior to use and when inserted into the beverage dispenser.

2. The pouch of claim 1, wherein the laminated material is a combination of PET, foil and polyethylene.

3. The pouch of claim 1, wherein the pouch has a length, a width and a top end, and the length is greater than the width, and a necked-down portion is defined at the top end thereof.

4. The pouch of claim 1, wherein the pouch has a length, a width, and a bottom edge, and the length is greater than the width, and the bottom edge is concave.

5. The pouch of claim 1, wherein the pouch has a bottom edge at a bottom end thereof that is positioned at an opposite end of the pouch to the top end and the bottom edge is concave.

6. A pouch for use in a beverage dispenser comprising:

a first layer on one side of the pouch and a second layer on an opposite side of the pouch sealed together around an outer periphery thereof to form a common rim, with the common rim positioned around the entire outer periphery of the pouch, said first and second layers together forming a cavity therebetween, said pouch being a soft pouch for holding a liquid or slurry content, with said pouch having a top end and a bottom end opposite the top end, with said first and second layers forming the entire exterior of the pouch; and an opening area on one or both of the first and second layers that is configured to permit a cutting blade to slice through the side and optionally the top end of the pouch to permit the contents to be substantially completely evacuated from the pouch via gravity, wherein in use the entire intact pouch is inserted into the beverage dispenser.

7. The pouch of claim 6, wherein the entire pouch is made of a flexible, sliceable material.

8. The pouch of claim 6, wherein the opening area is defined on at least one side of the pouch that accepts a cutting blade to open the pouch, and the opening area is soft, flexible, and sliceable.

9. The pouch of claim 8, wherein one or both of:

the opening area comprises less than one half of the length of the pouch; and the opening area comprises an area that is less than one half the width of the pouch.

10. The pouch of claim 8, wherein the first and second layers are integral.

11. The pouch of claim 8, wherein the pouch has a length and a width, and the length is greater than the width, and the pouch is configured to seat in a beverage dispenser lengthwise such that the length extends vertically permitting a cutting mechanism to slice through the opening area and the contents of the pouch can evacuate the pouch via gravity.

12. A method for making a mixed drink using a drink dispenser and the pouch of claim 6 comprising:

depositing the pouch having a liquid or a slurry content into a receiving receptacle of the drink dispenser by inserting the top end of the soft pouch into the receiving receptacle;

engaging a cutting mechanism that is positioned inside the drink dispenser to cut through at least a part of a side wall of the pouch to permit the contents of the pouch to at least in part exit the pouch and drain into a container;

pumping water from a water reservoir to mingle with the contents from the pouch and to drain into the container.

13. The method of claim 12, wherein the pouch is substantially completely evacuated via gravity after engaging with cutting mechanism.

14. The pouch of claim 6, wherein a top edge is positioned at the top end of the pouch and the top edge is convexly shaped.

15. The pouch of claim 14, wherein a bottom edge is positioned at a bottom end of the pouch and the bottom edge is concavely shaped.

16. The pouch of claim 6, wherein a bottom edge is positioned at a bottom end of the pouch and the bottom edge is concavely shaped.

* * * * *